US006013907A

United States Patent [19]

Lee

[11] Patent Number: 6,013,907

[45] Date of Patent: Jan. 11, 2000

[54] MICROWAVE OVEN EQUIPPED WITH THERMOPILE SENSOR AND THAWING METHOD USING THE SAME

[75] Inventor: Koon-Seok Lee, Kyungsangnam-Do, Rep. of Korea

[73] Assignee: LG Electronics Inc., Seoul, Rep. of Korea

[21] Appl. No.: 08/871,405

[22] Filed: Jun. 9, 1997

[51] Int. Cl.[7] ..... H05B 6/68

[52] U.S. Cl. ..... 219/703; 219/710; 219/718; 219/711; 99/325; 426/241; 426/524

[58] Field of Search ..... 219/703, 710, 219/711, 718, 708, 705; 99/325, DIG. 14; 426/241, 243, 524

[56] References Cited

U.S. PATENT DOCUMENTS

| | | | |
|---|---|---|---|
| 5,496,576 | 3/1996 | Jeong | 219/703 |
| 5,545,880 | 8/1996 | Bu et al. | 219/703 |
| 5,702,626 | 12/1997 | Kim | 219/711 |

FOREIGN PATENT DOCUMENTS

| | | | |
|---|---|---|---|
| 63-172831 | 7/1988 | Japan | 219/703 |
| 5-39929 | 2/1993 | Japan | 219/703 |

*Primary Examiner*—Philip H. Leung
*Attorney, Agent, or Firm*—Birch, Stewart, Kolasch & Birch, LLP

[57] ABSTRACT

An improved microwave oven equipped with a thermopile sensor and a thawing method using the same which make it possible to detect a food surface temperature by using a thermopile sensor, optimizing the output from the magnetron based on the detected food surface temperature, the size of the food, and the weight of the same, and determining an optimum thawing completion time, thereby obtaining the best thawing condition and significantly reducing the thawing time. The microwave oven includes a thermopile having a light condensing means for condensing an infrared ray from a food, a sensor module (a thermopile sensor) for generating a voltage corresponding to an infrared ray from the light condensing means and an infrared ray from the turntable, an amplifier for amplifying the output voltage from the sensor module to a predetermined level, an analog/digital converter for converting the voltage signal from the amplifier into a digital voltage signal, and a microcomputer for processing a voltage signal from the analog/digital converter, controlling the magnetron on/off switch in accordance with an algorithm with respect to an internally provided thawing program, and controlling an energy supplied from the magnetron to the food placed in a heating chamber.

15 Claims, 18 Drawing Sheets

FIG. 15A

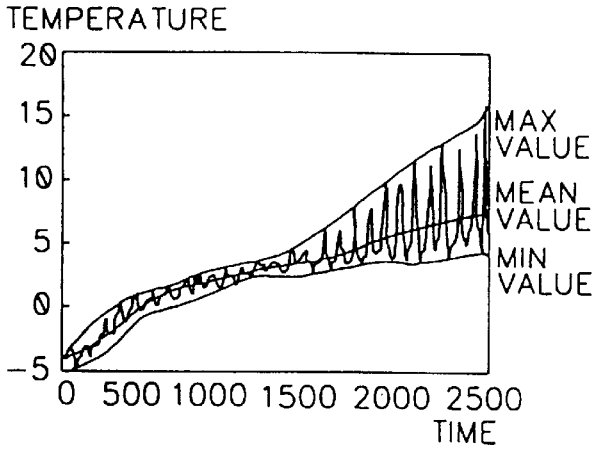

MAX VALUE : USED FOR COMPUTING VARIATION POINT IN THE PRESENT INVENTION
MEAN VALUE : USED FOR JUDGING ABNORMAL OPERATION AND FOOD STATE OF ALGORITHM IN THE PRESENT INVENTION
MIN VALUE : USED FOR COMPUTING OUTPUT POWER (ON/OFF TIME) OF MAGNETRON IN THE PRESENT INVENTION

FIG. 15B

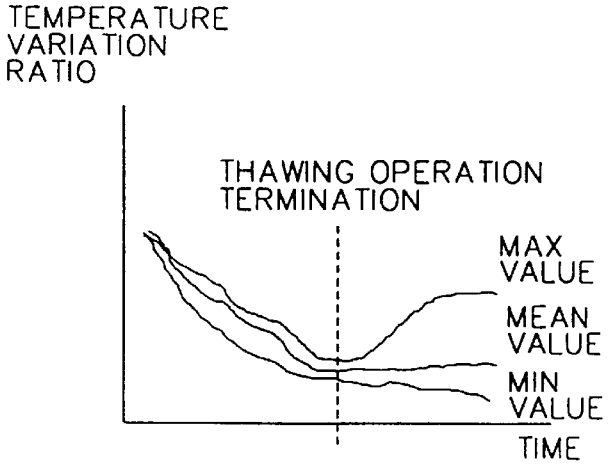

MAX VALUE : USED FOR COMPUTING VARIATION POINT IN THE PRESENT INVENTION
MEAN VALUE : USED FOR JUDGING ABNORMAL OPERATION AND FOOD STATE OF ALGORITHM IN THE PRESENT INVENTION
MIN VALUE : USED FOR COMPUTING OUTPUT POWER (ON/OFF TIME) OF MAGNETRON IN THE PRESENT INVENTION

MICROWAVE OVEN EQUIPPED WITH THERMOPILE SENSOR AND THAWING METHOD USING THE SAME

BACKGROUND OF THE INVENTION

1. Field of the Invention

The present invention relates to a microwave oven equipped with a thermopile sensor and a thawing method using the same. In particular, the present invention relates to an improved microwave oven equipped with a thermopile sensor, and a thawing method using the same. The thawing method involves detecting a food surface temperature using the thermopile sensor, optimizing the output from a magnetron of the microwave oven based on the detected food surface temperature, the size of the food and the weight of the same, and determining an optimum thawing completion time, thereby obtaining the best thawing condition and significantly reducing the thawing time.

2. Description of the Conventional Art

FIG. 1 illustrates the construction of a conventional microwave oven.

As shown therein, the conventional microwave oven includes a turn table 30 disposed in a center portion of a heating chamber 20 for placing a frozen food thereon, a magnetron 27 for supplying microwaves over the frozen food through a dope wave guide tube for thawing the frozen food, a turntable motor 29 for rotating the turntable 30, a thermopile sensor 21 disposed at an upper lateral portion of the heating chamber 20 for detecting the temperature of the frozen food and for converting the supplied voltage to a voltage corresponding to the detected temperature, a light 32 for lighting the interior of the heating chamber 20, a cooling fan 28 for cooling the magnetron 27, a microcomputer 22 for receiving a voltage from the thermopile sensor 21, determining thawing time, and outputting a control signal for controlling elements of the microwave oven, and control switches 23 through 26 for turning on/off the light 32, the magnetron 27, the cooling fan 27, and the turntable motor 29 in accordance with a control signal from the microcomputer 22. Additionally, a weight sensor (not shown) is connected to the motor shaft of the turntable for weighing the weight of the frozen food.

The thawing operation of the frozen food using the conventional microwave oven will now be explained with reference to FIGS. 1 through 4C.

The frozen food 31 is placed on the turntable 30 disposed in the heating chamber 20, as shown in FIG. 1, and a front door is closed. When the thawing switch is selected, the microcomputer recognizes the thawing mode, and the thawing operation shown in FIG. 3 is performed as described below.

In step S1, the microcomputer 22 turns on the control switches 23 through 26 for driving the magnetron 27, the cooling fan 28, the turntable motor 29, and the light 32.

The turntable 30 is rotated by the turntable motor 29.

When the turntable 30 is rotated, the microcomputer 22 measures the weight of the frozen food 31 using a weight sensor (not shown) attached to the motor shaft (not shown) of the turntable (step S2).

The time Q elapsing during one rotation of the turntable 30 is computed based on one period time T0 of a supply power and a count P of the turntable motor 29 (step S3), according to:

$$Q=(1/T0)/P.$$

In the conventional art, the computation is performed assuming P=5 and T0=20 msec, such that Q=10 sec.

After the computation of one rotation time Q of the turntable 29 is finished in step S3, and after a delay of 250 msec in step S4, the microcomputer 22 controls the system so that the magnetron 27 generates a series of outputs corresponding to 0 watts, 300 watts, and 600 watts, as shown in FIG. 2 (step S5).

When the output from the magnetron 27 is controlled and the magnetron 27 is turned off (step S6), the voltage from the thermopile sensor 21 is received. Based on the voltage from the thermocouple, a voltage V which is proportional to the temperature of the frozen food 31 is computed (step S7) as follows:

$$V=R*(V1-V3)+S*V2+T,$$

where V1 denotes the voltage which is obtained by amplifying the output from the thermopile sensor 21, V2 denotes the voltage of the thermostat, V3 denotes the reference voltage of the thermopile sensor, and R, S and T denote coefficients.

The voltage V corresponding to the temperature of the frozen food 31 is thus computed. Thereafter, and it is checked whether one rotation time (Q seconds) of the turntable 30 has lapsed (step S8). When one rotation time (Q seconds) of the turntable 30 has lapsed, the weight W of the frozen food 31 is measured (step S9).

When the magnetron 27 is turned off and the weight W of the frozen food 31 measured during one rotation of the turntable 30, the amount of time T1 necessary for the magnetron 27 to output 600 Watts is computed (step S10) as follows:

$$T1=0.06*W,$$

where W represents the weight of the frozen food.

Even though the thermopile sensor 21 does not detect the thawing completion state, the following formulas are used to compute the timing TLmax (hereinafter called a maximum thawing completion time) at which the thawing operation is completed, and the timing TLmin, (hereinafter called a minimum thawing completion time) at which the heating of the magnetron is stopped:

$$TLmax\ 2*W,$$

$$TLmin\ 1*W.$$

When the maximum and minimum completion timing TLmax and TLmin are obtained, the routine is returned to step S4, and steps S4 through S8 are performed.

In addition, after step S8, when the rotation time (Q seconds) has lapsed after two rotations of the turntable 30, it is checked whether the thawing time is between the minimum thawing completion time TLmin and the maximum thawing completion time TLmax (steps S12 and S13).

If the thawing operation time exceeds the minimum completion time TLmin and the maximum thawing completion time TLmax, the operation is determined to have achieved thawing completion. If the thawing operation time exceeds the minimum thawing completion time TLmin but does not exceed the maximum thawing completion time TLmax, the values L and M are computed as follows (step S14 and S15):

L=min/ave, and m=dV/dt, where min denotes the minimum voltage value which is obtained during one rotation of the turntable, ave denotes the average value, and dV/dt denotes the value which is obtained by differentially computing the voltage V with respect to the time.

The value L is an evaluation value by which the variation amount of the voltage data measured during one rotation of the turntable 30 is computed, and M denotes the value by which it is judged whether the temperature of the food is rapidly increased.

The value L is shown in FIG. 4A. In the case of a large load, the value is shown in FIG. 4B, and when the temperature is within the upper and lower portions of the infrared ray range, namely in the case of a small load, the value L is shown in FIG. 4C.

Therefore, in step S14, the value L is compared with the reference value of 0.094, which is used for judging the variation amount of the voltage data when the minimum thawing completion time TLmin was exceeded but the maximum thawing completion time TLmax was not exceeded.

As a result of the comparison, if the value L is smaller than the reference value of 0.094, the value is presumed to be within the range of an infrared ray as shown in FIG. 4C. Therefore, it is judged that thawing is completed. If the value L is larger than the reference value of 0.094, the value is presumed to correspond to a proper or a larger load, as shown in FIGS. 4A and 4B. Therefore, thawing completion is not assumed. Rather, the size of the value M is compared with the reference value of 10 in step S15 in order to select one of two values.

When the value M is smaller than the reference value of 10, the load is determined to be a load in which the temperature of the center portion of the food is not increased. Therefore, the thawing operation is determined to be completed only after the time reaches the maximum thawing completion time TLmax.

If the value M is larger than the reference value of 10, the load is determined to be a load in which the temperature of the center portion of the food is increased. Therefore, it is judged that the thawing operation is completed.

In the thawing method with respect to the frozen food, the surface temperature of the food 31 is measured by using the thermopile sensor 21. The output from the magnetron 27 is controlled based on the time which is obtained by measuring the weight W of the frozen food by using the weight sensor. Therefore, the thawing completion time is determined.

The food is heated by the high output (600 Watt) during the time of T1 0.06W, which is set in proportion to the weight W of the frozen food measured by the weight sensor. Thereafter, the voltage of 300 Watt is supplied during one rotation (Q seconds) of the turntable 30, and then the voltage of 300 Watt is not supplied during one rotation (Q seconds) of the turntable 30.

Thus, in the conventional art, the weight sensor is used for controlling the output of the magnetron for the time T1 when heating the frozen food by high voltage. Thus, the fabrication and maintenance cost is increased. In addition, when thawing a large amount of the frozen food by using the voltage of 300 Watt after the time T1, a lengthy time is needed to achieve the thawing completion time. Furthermore, since the output of the magnetron is strong compared to a smaller load, the food may be partially heated. In addition, the frozen food may be not evenly heated by an over thawing operation. Still further, if the food to be cooked is eccentrically placed on the turntable, the weight of the food may be erroneously determined, thereby causing malfunction.

SUMMARY OF THE INVENTION

Accordingly, it is an object of the present invention to provide a microwave oven equipped with a thermopile sensor and a thawing method using the same which overcome the aforementioned problem encountered in the conventional art.

It is another object of the present invention to provide an improved microwave oven equipped with a thermopile sensor and a thawing method using the same which make it possible to read the data from a thermopile sensor, and continuously control the output from the magnetron in accordance with the read data, thus outputting an optimum output from the magnetron irrespective of the size of a food and the weight of the same.

It is another object of the present invention to provide an improved microwave oven equipped with a thermopile sensor and a thawing method using the same which make it possible to determine a food surface phase transition time, for which a food surface phase is changed from an iced state to a liquid state, based on the data from the thermopile sensor, thus more rapidly thawing a frozen food.

It is another object of the present invention to provide an improved microwave oven equipped with a thermopile sensor and a thawing method using the same which make it possible to determine a thawing completion time by using a value which varies in accordance with the variation amount of a temperature which is measured for one rotation time of a turntable and an eccentric amount of a load (food), thus achieving an optimum thawing operational condition.

It is another object of the present invention to provide an improved microwave oven equipped with a thermopile sensor and a thawing method using the same which make it possible to detect a food surface temperature by using a thermopile sensor, optimizing the output from the magnetron based on the detected food surface temperature, the size of the food, and the weight of the same, and determining an optimum thawing completion time, thereby obtaining the best thawing condition and significantly reducing the thawing time.

To achieve the above objects, there is provided a microwave oven equipped with a thermopile sensor which comprises a microcomputer including a voltage signal sampling unit for reading a digital signal from the analog/digital converter at every time ts, a voltage signal processing unit for converting the voltage signal sampled at every voltage time into a temperature T, eliminating a noise from the converted temperature T, and computing a maximum value Tmax, a minimum value Tmin, and a mean value Tmean of a temperature for a magnetron on/off period (tm) time, a temperature data sampling unit for sampling the maximum value Tmax, the minimum value Tmin, and the mean value Tmean with respect to the temperature T at a magnetron on/off period, a magnetron turn-on time ratio computation and abnormal operation judging unit for computing an optimum magnetron on/off time at a magnetron on/off period by using the data sampled by the temperature data sampling unit, determining the thawing completion time so that the thawing operation is terminated at optimum time, and terminating the thawing operation when there is an abnormal operation by judging the state of the food, and a magnetron on/off switch controller for outputting a control signal to the magnetron on/off switch in accordance with an output from the magnetron turn-on time ratio computation and abnormal operation judging unit and controlling an output from the magnetron, wherein the microwave oven equipped with a thermopile includes a light condensing means for condensing an infrared ray from a food, a sensor module (a thermopile sensor) for generating a voltage corresponding to an infrared ray from the light condensing means and an infrared ray from the turntable, an amplifier for amplifying the output voltage from the sensor module to a predetermined level, an analog/digital converter for converting the voltage signal from the amplifier into a digital voltage signal, and a microcomputer for processing a voltage signal from the analog/digital converter, controlling the magnetron on/off switch in accordance with an algorithm with respect to an internally provided thawing program, and controlling an energy supplied from the magnetron to the food placed in a heating chamber.

To achieve the above objects, there is provided a thawing method using a microwave oven equipped with a thermopile type sensor which includes the steps of a first step for turning off a magnetron for time which is obtained by combining one rotation time of a turntable when a thawing key is inputted and a rotation response time until a turntable motor is normally rotated and detecting an initial temperature T of a food, a second step for filtering a temperature T detected in the first step to Tf by using a digital filter and computing a maximum value Tmax, a minimum value Tmin, and a mean value Tmean for a magnetron on/off period with respect to the filtered temperature Tf, a third step for judging whether a magnetron on/off period lapsed, returning to the first and second steps when the magnetron on/off period did not lapse as a result of the judgment, and computing a filtering value Tmaxf by filtering the maximum value Tmax when the magnetron on/off period lapsed, a fourth step for computing the varied value ΔTmaxf of the filtering value Tmaxf of the maximum value Tmax in the third step and judging the increased amount of the value, a fifth step for computing an additional thawing time ta when the varied value ΔTmaxf is increased in the fourth step, determining a thawing completion time, computing a magnetron turn-on time ratio, and computing the magnetron turn-on time ratio when the varied value ΔTmaxf is not increased, a sixth step for judging an operation state of a thawing algorithm and an abnormal state of a food by using a magnetron turn-on time ratio, and the mean value Tmean, and a current lapse time, and a seventh step for terminating a thawing operation by turning off the magnetron when the operation is judged to be an abnormal state in the sixth step and returning to the first step when the operation is judged not to be an abnormal state.

To achieve the above objects, there is provided a thawing method using a microwave oven equipped with a thermopile type sensor according to another embodiment of the present invention, which includes the steps of a first step for computing a variation amount of a measuring temperature for one rotation time of a turntable, a second step for computing a value Kd which varies in accordance with an eccentric amount corresponding to the variation amount computed in the first step, a third step for computing a magnetron turn-on time ratio p by multiplying a temperature value which is obtained by subtracting an initial temperature from the current temperature of a load at every a magnetron on/off period (tm) with different weights, and a fourth step for terminating a thawing operation when the value which is obtained by multiplying the value of Kd by a load temperature variation amount measured at every magnetron on/off period (tm).

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4A through 4C are graphs of a value L when thawing a frozen food in the conventional microwave oven, of which:

FIG. 4A is a graph illustrating a value L when a load is proper;

FIG. 4B is a graph illustrating a value L when a load is high; and

FIG. 4C is a graph illustrating a value L when a load is small; and

FIG. 15 is graphs illustrating a temperature variation and temperature variation characteristic with respect to the maximum value, average value, and minimum value with respect to the temperature according to the present invention;

DETAILED DESCRIPTION OF THE INVENTION

Figure 1:
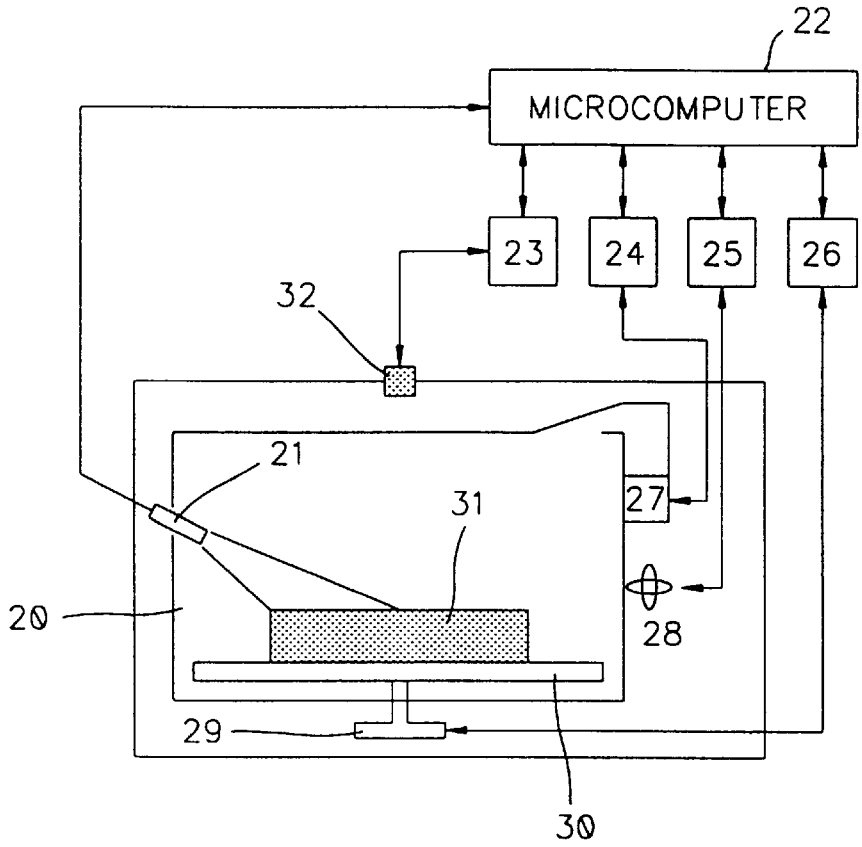
FIG. 1 CONVENTIONAL ART
FIG. 1 is a schematic block diagram illustrating the construction of a conventional microwave oven.
Figure 2:
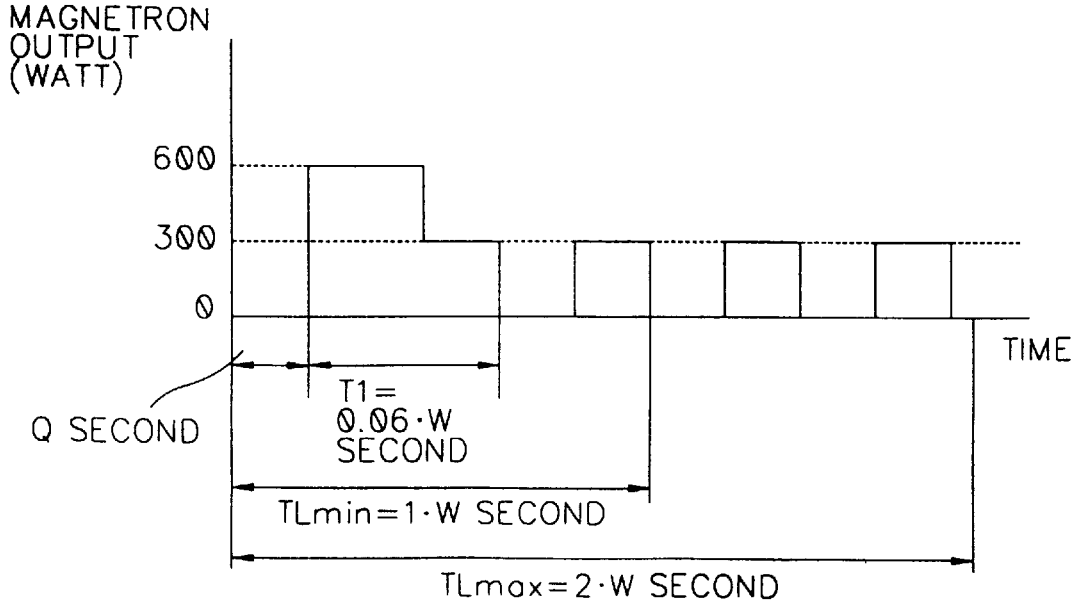
FIG. 2 CONVENTIONAL ART
FIG. 2 is a waveform diagram of a magnetron output control signal for thawing a frozen food in the conventional microwave oven.
Figure 3:
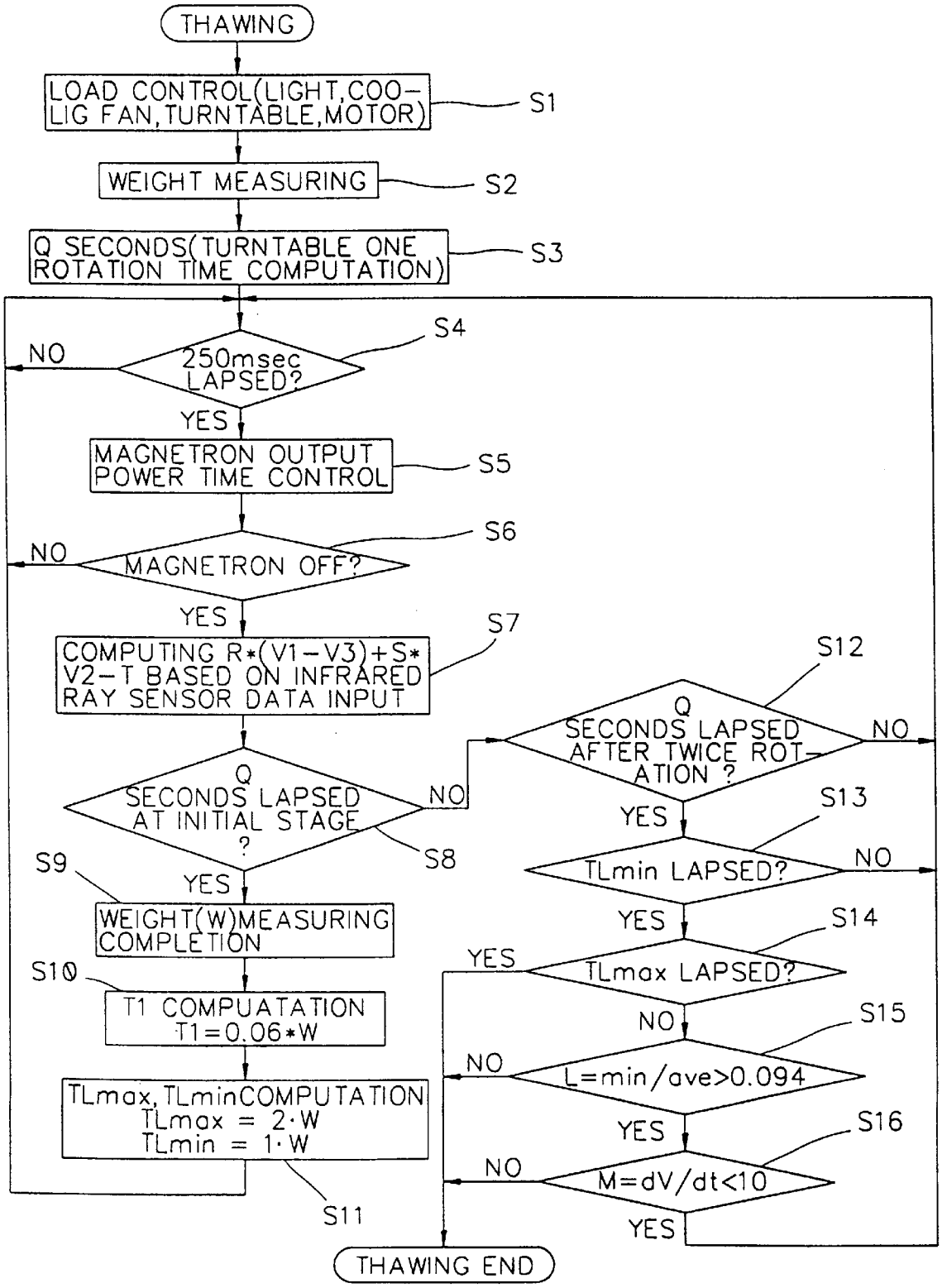
FIG. 3 CONVENTIONAL ART
FIG. 3 is a flow chart illustrating a thawing method for a conventional microwave oven.
Figure 4A:
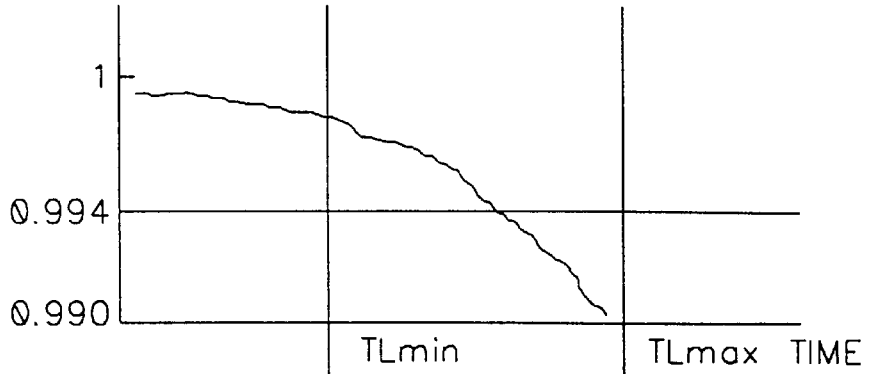
Figure 4B:
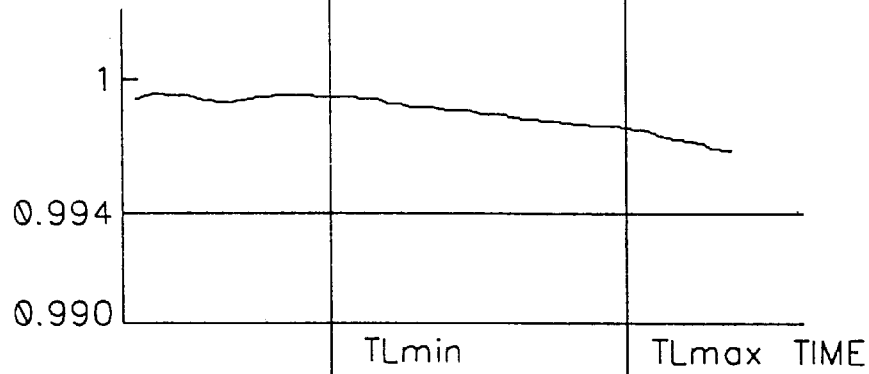
Figure 4C:
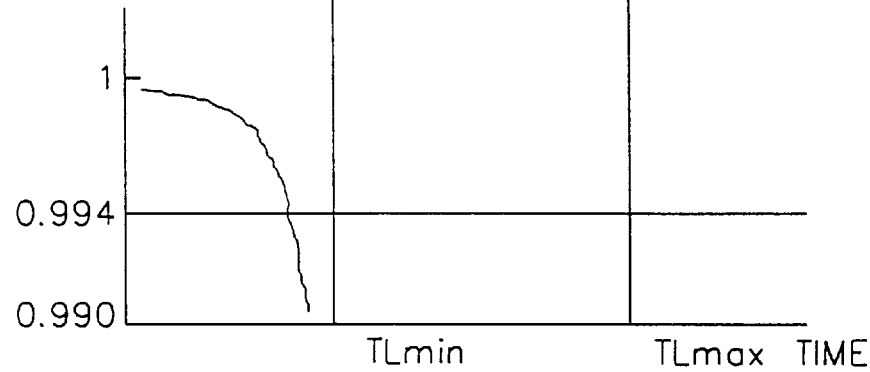

FIGS. 5 through 13 illustrate the construction of a microwave oven equipped with a thermopile sensor according to the present invention.

As shown therein, a microwave oven equipped with a thermopile sensor according to the present invention includes: a sensor module 2 for generating a voltage based on output from a light condensing unit (not shown) for condensing an infrared ray from the food 10, a sensor module 2 for generating a voltage corresponding to the infrared ray from the light condensing unit and the infrared ray from the turntable 9, an amplifier 3 for amplifying the voltage output from the sensor module 2 to achieve a predetermined level, an analog/digital converter 4 for converting the voltage signal from the amplifier 3 into a digital voltage signal, and a microcomputer 5 for processing the voltage signal from the analog/digital converter 4, for controlling a magnetron on/off switch 6 in accordance with an algorithm based on the thawing program, and for controlling the energy from the magnetron 7 supplied to the food 10 provided in the heating chamber 1.

Figure 14:
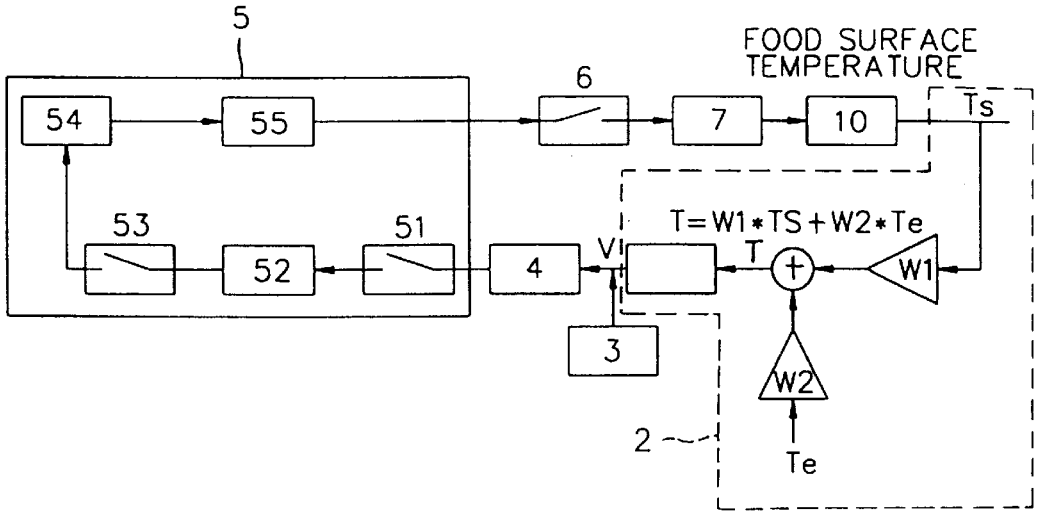
FIG. 14 is a detailed block diagram illustrating a microcomputer in the microwave oven of FIG. 5 according to the present invention.

As shown in FIG. 14, the microcomputer 5 includes a voltage signal sampling unit 51 for reading the digital signals from the analog/digital converter 4 at every time ts, a voltage signal processing unit 52 for converting the voltage signal sampled at every voltage time into the temperature T, eliminating noise contained in the converted temperature T, and outputting the maximum value Tmax, minimum value Tmin, and mean value Tmean of the temperature for the magnetron on/off period tm, a temperature data sampling unit 53 for sampling the maximum value Tmax, minimum value Tmin, and mean value Tmean with respect to the temperature T at every magnetron on/off period, a magnetron turn-on time ratio computation and abnormal operation judging unit 54 for computing an optimum magnetron on/off time at every magnetron on/off period by using the data sampled by the temperature data sampling unit 53, determining the thawing completion timing so that the thawing operation is finished at the optimum time, determining whether there is an abnormal state in the food, and discontinuing the thawing operation if an abnormal state is determined to exist, and a magnetron on/off switch controller 55 for outputting a control signal to the magnetron on/off switch 6 in accordance with the output from the magnetron turn-on time ratio computation and abnormal operation judging unit 54.

The microcomputer 5 contains algorithms such as an algorithm for converting the voltage signal sampled at every time ts into the temperature T, a digital filter algorithm for eliminating noise contained in the temperature T, a maximum value computation algorithm for computing the maximum value Tmax for the magnetron on/off period tm, a minimum value computation algorithm for computing a minimum value Tmin of the temperature for the magnetron on/off period tm, and a mean value computation algorithm for computing a mean value of the temperature for the magnetron on/off period tm.

In addition, the thawing method for a microwave oven using the thermopile sensor according to the present invention includes the following series of steps. A first step turns off the magnetron for a time period that is obtained by summing one rotation time of the turntable at the initial stage of the thawing operation and a rotation response time period that is required before the turntable is able to normally rotate, and detects the initial temperature T of the food. A second step filters the initial temperature T detected in the first step into a temperature Tf by using the digital filter, and computes the maximum value Tmax, minimum value Tmin, and mean value Tmean for the magnetron on/off period with respect to the filtered temperature Tf. A third step determines whether the magnetron on/off period has lapsed, performs the first and second steps if the period has not yet lapsed, and computes the filtering value Tmaxf by filtering the maximum value Tmax. A fourth step computes the varied value ΔTmaxf of the filtering value Tmaxf of the maximum value Tmax in the third step, and determines whether an increased state is experienced by the same. A fifth step computes an additional thawing time ta when the varied value ΔTmaxf was increased in the fourth step determines a thawing completion timing, computes the magnetron turn-on time ratio, and computes a magnetron turn-on time ratio if the varied value ATmaxf was not increased. A sixth step determines an abnormal operation state of the thawing algorithm and the state of the food based on the magnetron turn-on time ratio, the mean value Tmean and the lapse time until the present time. A seventh step discontinues the thawing operation by turning off the magnetron when it is determined that there is an abnormal operation state in the sixth step, and returns the routine to the first step when the operation state is normal.

The increasing state with respect to the varied value ΔTmaxf of the filtering value Tmaxf of the maximum value Tmax in the fourth step will now be explained.

When the present lapse time tr is smaller than the magnetron on/off 3-period (3*tm), the value ΔTmaxf(tr) representing the current value ΔTmaxf is compared with the value ΔTmaxf(tr−tm) representing the value ΔTmaxf before the time of Tm has lapsed. As a result, if the value ΔTmaxf(tr) is larger than the value ΔTmaxf(tr−tm), the value ΔTmaxf is determined to be being increased, and if the value ATmaxf is smaller than the same, the value ΔTmaxf is not determined to be being increased.

In addition, the increasing state with respect to the varied value ΔTmaxf of the filtering value Tmaxf of the maximum value Tmax in the fourth step will now be explained.

When the current lapse time tr is larger than the magnetron on/off 3-period (3*tm), the value ΔTmaxf(tr) representing the current value ΔTmaxf and the values ΔTmaxf(tr−tm) and ΔTmaxf(tr−2*m) representing the value ΔTmaxf before the time of 2*tm are compared with each other. As a result of the comparison, if the value ΔTmaxf(tr) is larger than the value Tmaxf(tr−tm), or if the value ΔTmaxf(tr) is larger than the value ΔTmaxf(tr−2*tm)+δ (positive number larger than 0), the value ΔTmaxf is determined to be being increased. In other cases, the value is determined to be being increased.

Figure 25:
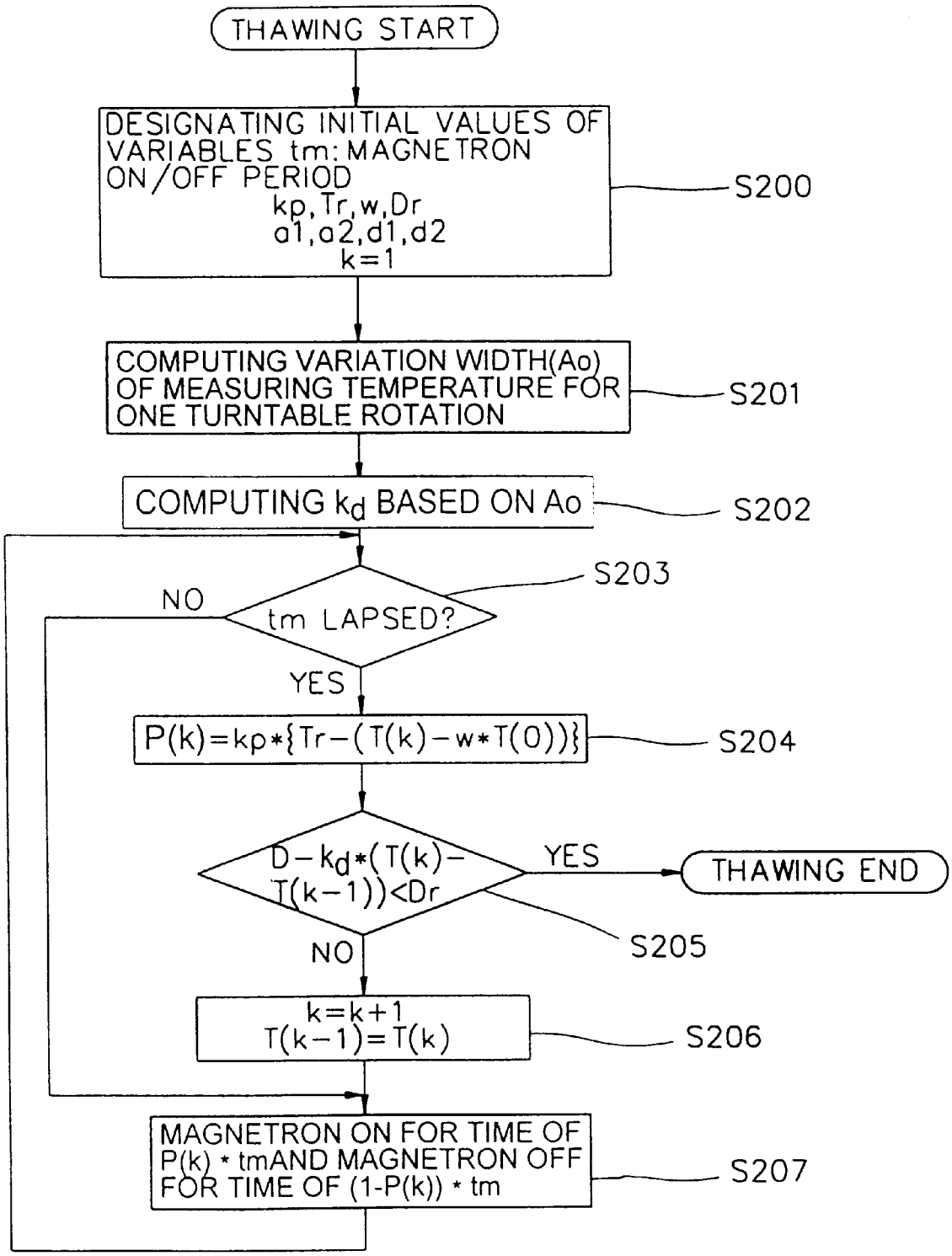
FIG. 25 is a flow chart illustrating a thawing method for a microwave oven using a thermopile sensor according to the present invention.

As shown in FIG. 25, the thawing method of a microwave oven equipped with the thermopile sensor according to the present invention includes the following series of steps. A first step computes a variation amount of a measuring temperature during one rotation time of the turntable at an initial stage (step S201). A second step computes the value Kd in accordance with the eccentric amount which matches with the variation amount computed in the first step (step S202). A third step multiplies the relative temperature value, which is obtained by subtracting the initial temperature of the load from the current temperature at every magnetron on/off period tm, by different weights, for thus computing the magnetron turn-on time ratio P (step S204). A fourth step stops the thawing operation when a value, which is obtained by subtracting the value obtained by multiplying the load temperature varied amount measured at every magnetron on/off period tm by the value Kd from the magnetron turn-on time ratio P obtained in the third step, is smaller than a constant value Dr (step S205).

The operation of the microwave oven equipped with the thermopile sensor and the thawing method using the same according to the present invention will now be explained with reference to the accompanying drawings.

Figure 5:
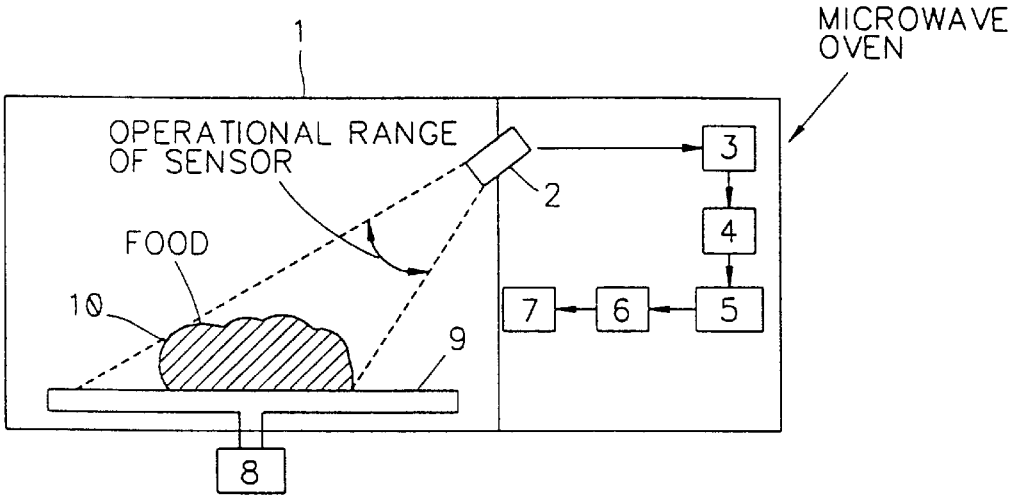
FIG. 5 is a block diagram illustrating a microwave oven with a thermopile sensor according to the present invention.

First, as shown in FIG. 5, when the frozen food 10 to be thawed is placed on the turntable 9 disposed in the heating chamber 1, and then a thawing key (not shown) is inputted, the microcomputer 5 outputs a driving signal to the turntable motor 8 and turns on the magnetron on/off switch 5 based on the above described operation.

Thereafter, as the turntable 9 is rotated by the turntable motor 8, and the magnetron on/off switch 5 is turned on, the magnetron 7 is driven to output microwaves over the frozen food 10 placed on the turntable 9, thereby thawing the frozen food 10.

The infrared rays generated from the food 10 during the thawing operation are condensed by the light condensing unit of the sensor module 2 and then are transmitted to the thermopile sensor (not shown). The thermopile sensor converts the condensed infrared rays into a voltage, and the voltage is outputted to the amplifier 3.

The light condensing unit includes a convex lens or a concave reflection mirror for narrowing the field-of-view of the thermopile sensor and for increasing the output voltage of the thermopile sensor.

Figure 7:
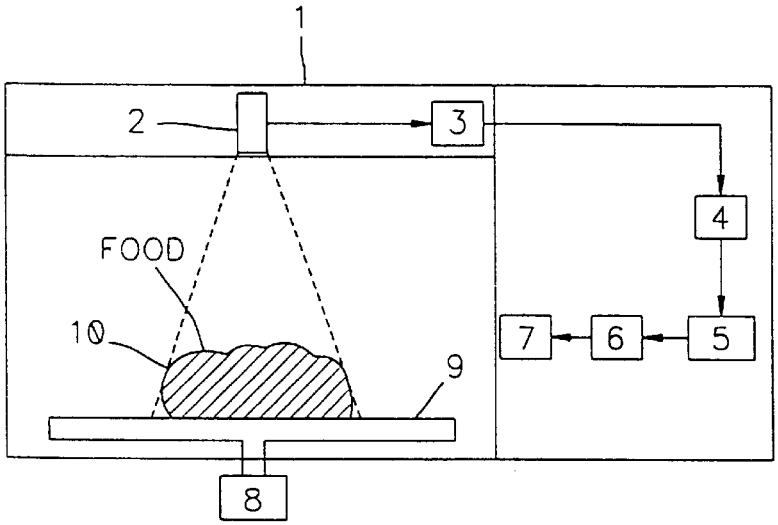
FIG. 7 is a block diagram illustrating a microwave oven with a thermopile sensor according to another embodiment of the present invention.

The sensor module 2 shown in FIG. 5 may be slanted at a predetermined angle so that the turntable 9 is seen from the lateral upper portion of the heating chamber 1, and, as shown in FIG. 7, it may be spaced-apart from the center portion of the heating chamber 1. Therefore, it is possible to measure the temperatures at the central and lateral portions of the turntable 9.

The size of the food placed on the turntable 9 and the installation angle of the sensor module 2 will now be explained.

Figure 6A:
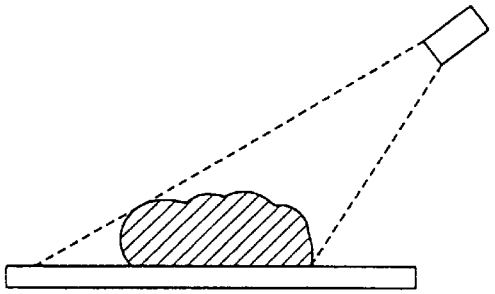
FIGS. 6A and 6B are diagrams illustrating an operational range between food to be cooked and a sensor module disposed in an upper portion of a heating chamber of a microwave oven according to the present invention.
Figure 6B:
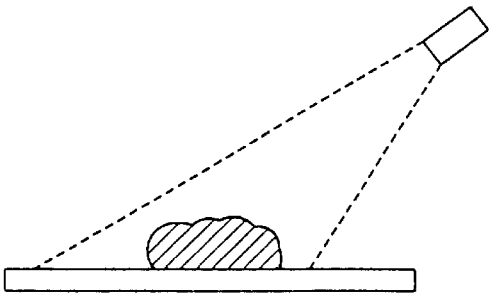
Figure 8A:
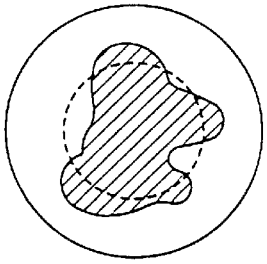
FIGS. 8A and 8B are diagrams illustrating an operational range between a food to be cooked and a sensor module disposed in an upper portion of a heating chamber according to the present invention.
Figure 8B:
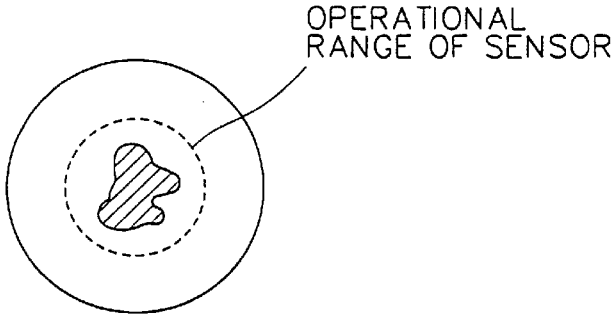

FIGS. 6A and 6B illustrate the sensor module 2 installed at a lateral surface of the heating chamber 1. FIGS. 8A and 8B illustrate the sensor module 2 installed at an upper portion of the heating chamber 1. The installation angles of the same will be explained later in more detail.

The amplifier 3 amplifies the output voltage from the sensor module 2 to a predetermined level so that the voltage is processed by the analog/digital converter 4, and then outputs the amplified voltage to the analog/digital converter 4.

The analog/digital converter 4 converts the analog voltage signal amplified to a predetermined level with respect to the temperature of the food into the digital voltage data, and then outputs the converted digital voltage data to microcomputer 5.

The microcomputer 5 processes the digital voltage data, and the algorithm with respect to the thawing program is performed based on the thusly processed voltage data, thereby determining the thawing timing. The magnetron on/off switch 6 is controlled in accordance with the algorithm.

Here, the magnetron on/off switch 6 includes a relay unit, a transistor, etc.

Therefore, the magnetron 7 which is controlled by the magnetron on/off switch 6 is driven, thus generating microwaves over the food 10 provided in the heating chamber 1.

In addition, the turntable motor 8 rotates the turntable 9 at a predetermined time period, thus evenly heating the food.

Figure 9A:
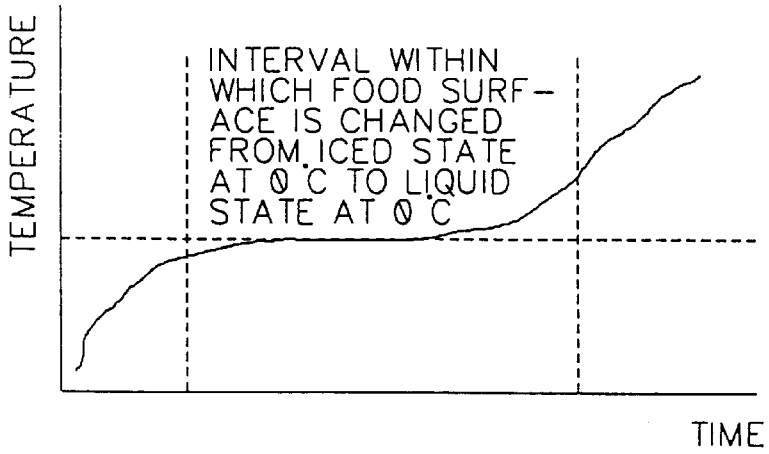
FIGS. 9A and 9B are graphs illustrating the surface temperature variations of a food when thawing the same according to the present invention.
Figure 9B:
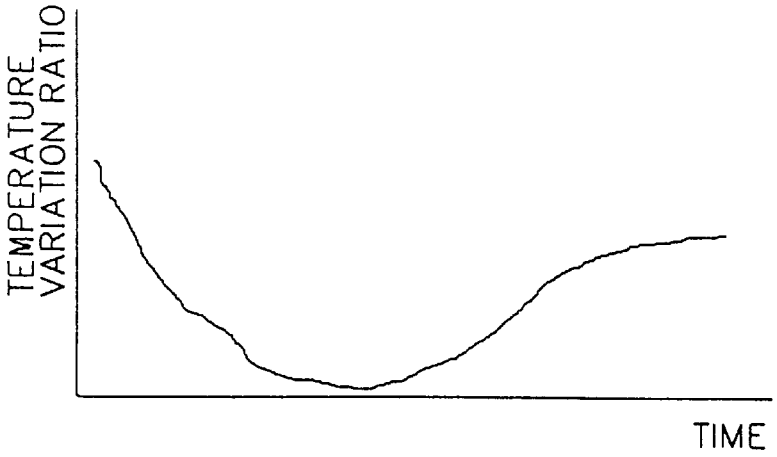

FIGS. 9A and 9B illustrate the variation of the food surface temperature when the frozen food is heated.

Namely, the variation of the food surface temperature is shown as two variation points in FIG. 9A. The surface temperature is increased until the first variation point appears in a state that an iced food surface remains. In addition, from the first variation point to the second variation point, the food surface is changed from the iced solid state at a temperature of 0 degree to the liquid state at a temperature of 0 degree.

The energy supplied from the magnetron 7 is consumed for the above-described surface phase state conversion. Therefore, there is no food surface temperature variation.

Thereafter, the food is continuously heated, the surface phase variation occurs. At this time, the surface temperature of the food remains at a temperature of 0° C.

The food surface temperature variation ratio is reduced at a time when the phase transition appears as shown in FIG. 9B. Since there is no temperature variation at a time when the phase transition appears, the temperature variation ratio is 0. Thereafter, the temperature variation ratio is increased.

In an operation of thawing the frozen food, the thawing completion timing is determined based on the time when the phase transition from the iced state to the liquid state is finished.

The time when the phase transition from the iced state to the liquid state is a time when the temperature variation ratio is increased above 0.

However, when actually measuring the food surface temperature by using the thermopile sensor, the temperature variation shown in FIGS. 9A and 9B is higher than the temperature variation shown in FIGS. 10A through 10D.

Figure 10A:
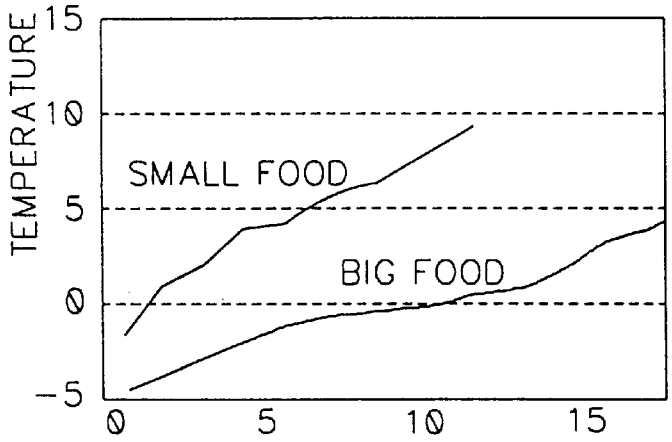
FIG. 10A is a graph illustrating an interrelationship between a variation of a surface temperature of a food and a variation ratio when a food is placed on the center portion of a turntable according to the present invention.
Figure 10B:
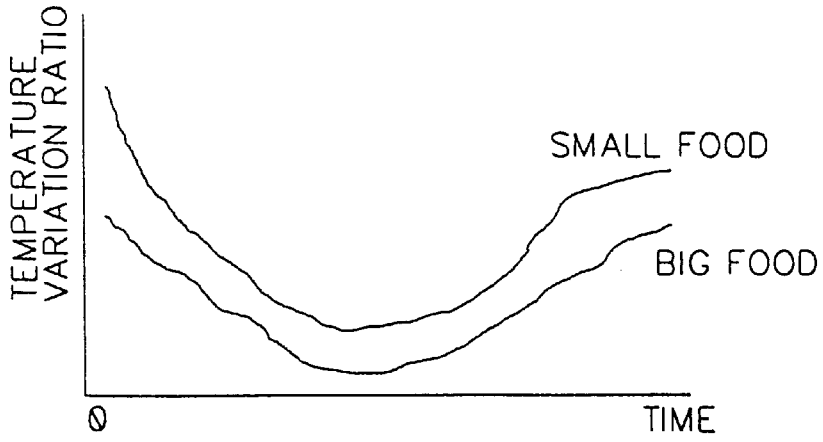
FIG. 10B is a graph illustrating an interrelationship between a variation of a surface temperature of a food and a variation ratio when a food is placed beside the center portion of a turntable according to the present invention.
Figure 10C:
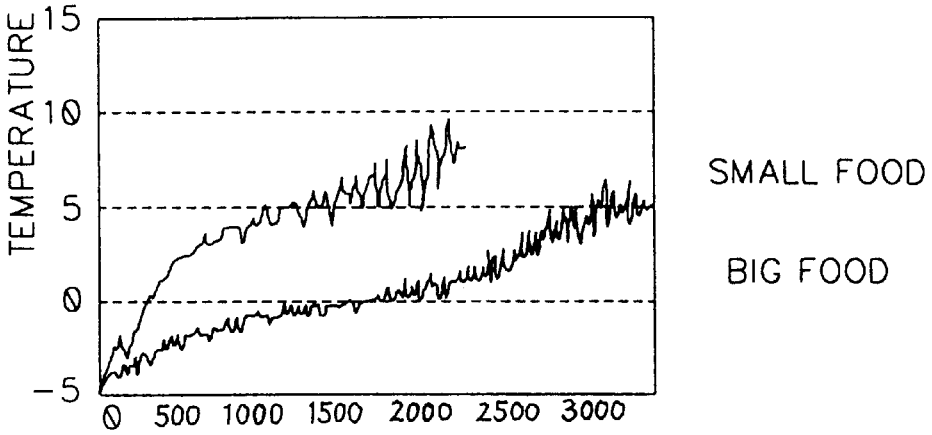
FIGS. 10C and 10D are graphs illustrating a comparison of thawing conditions between a small food and a big food, FIG. 10D comparing thawing conditions when an interrelationship is computed based on the maximum value at every magnetron on/off period according to the present invention.
Figure 10D:
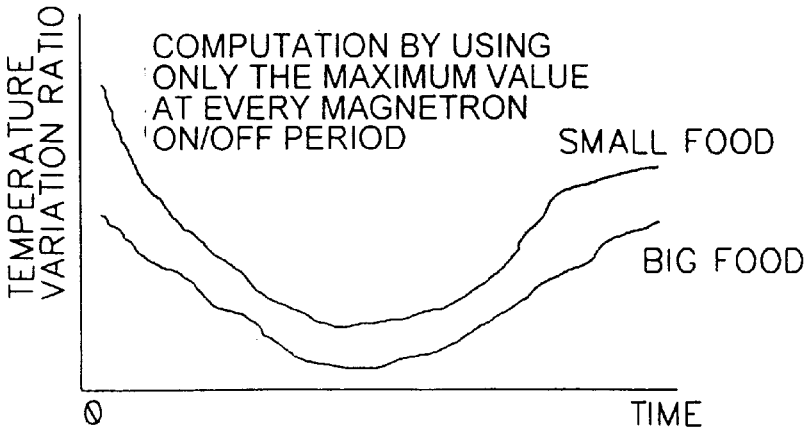

Namely, when the phase transition is performed from the iced state to the liquid state, no temperature variation is ideally needed. As shown in FIGS. 10A and 10D, the measuring temperature is increased within the phase transition interval.

The above-described increase, as shown in FIGS. 6A through 8B, is due to the field-of-view of the thermopile sensor and the size of the food.

FIGS. 6A and 6B illustrate an interrelationship between the field-of-view and the size of the food when the thermopile sensor is installed in a lateral upper portion of the heating chamber 1. Since only the infrared ray generated from the surface of the food is made incident onto the thermopile sensor when the food is big, the food surface temperature is shown in FIGS. 9A and 9B.

By contrast, as shown in FIG. 6B, when the food is small, the infrared ray from the food as well as the infrared ray from the turntable 9 are made incident onto the thermopile sensor.

Therefore, the characteristics of the food surface temperature variation as shown in FIGS. 10A through 10D are obtained.

FIGS. 8A and 8B illustrate an interrelationship between the field-of-view and the size of the food when the thermopile sensor is installed in an upper portion of the heating chamber 1. As shown in FIG. 8A, only the infrared ray from the surface of the food is made incident onto the thermopile sensor when the food is big. Therefore, the characteristics of the food surface temperature variation as shown in FIGS. 9A and 9B are obtained.

In addition, as shown in FIG. 8B, both the infrared ray from the food and the infrared ray from the turntable 9 are incident onto the thermopile sensor when the food is small.

Therefore, the characteristics of the food surface temperature variation as shown in FIGS. 10A through 10D are obtained, where the characteristics obtained for small food typically exceed those for larger food due to the incidence from the turn table.

As a result, it is possible to avoid the partial over-thawing and less-thawing of the food by indirectly judging the size of the food based on the food surface temperature and properly controlling the output from the magnetron 7 in accordance with the size of the food.

In addition, as shown in FIGS. 10A through 10D, the measuring temperature for small food is higher than the measuring temperature for large food at the time when the iced state of the food surface is converted into the liquid state.

The heating time of the magnetron with respect to the small food is lengthy compared to the big food. The optimum magnetron output may be determined in accordance with the size of the food by using the measuring temperature of the thermopile sensor.

The process for determining the optimum magnetron output will now be explained.

Assuming that the magnetron turn-on time ratio is P, and the food surface temperature is T, the magnetron turn-on time ratio P is determined by the following equation (1):

$$P=f(T) \quad (1).$$

Assuming that the magnetron turn-on time is ton, and the magnetron turn-off time is toff, an Equation of P=ton/(ton+toff) is obtained. f(T) denotes the function which may be expressed in a linear or non-linear equation form with respect to the temperature T, assuming that the magnetron on/off period tm is constant.

In accordance with Equation (1), since the magnetron on/off period tm is constant, the temperature T is measured or computed at a predetermined period tm.

Therefore, the magnetron turn-on time ratio P is recomputed during a magnetron on/off period tm and then is changed.

For example, when heating small and big foods having the surface temperature of about −5° C., as shown in FIGS. 10A through 10D, assuming that the magnetron turn-on time ratio is 80% with respect to the big food (for example, the magnetron is turned on for 8 seconds and is turned off for 2 seconds) in an optimum state, the small food must be heated at the magnetron turn-on time ratio which is smaller than that of the big food (for example, 60%), thus preventing over-thawing.

Therefore, the magnetron turn-on time ratio P is determined such that the ratio P is inversely proportional with respect to the food surface temperature.

The magnetron turn-on time ratio P is determined based on a first order proportional equation:

$$P=K1*(Tr-T) \quad (2),$$

here K1 denotes a proportional constant, and Tr denotes a constant.

Figure 11:
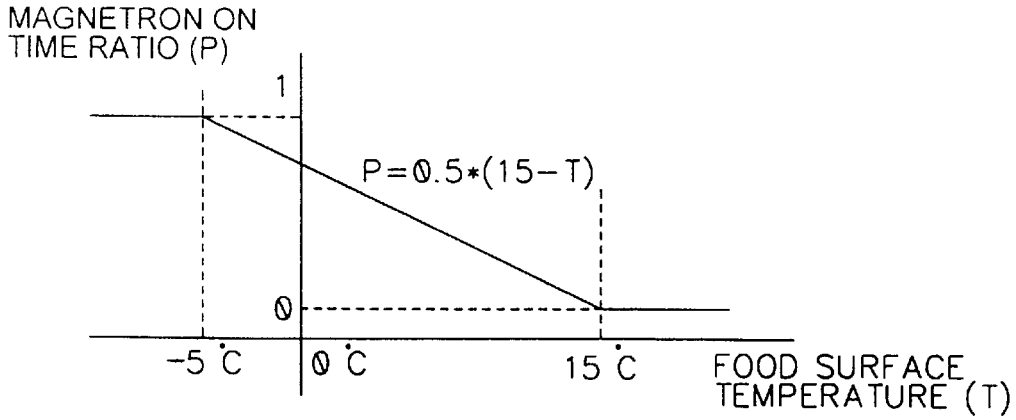
FIG. 11 is a graph illustrating a magnetron turn-on time ratio P in accordance with a surface temperature of a food according to the present invention.

FIG. 11 denotes an example of Equation (2).

Since the magnetron turn-on time ratio P cannot be greater than 1, the temperature T cannot be smaller than 5° C.

Since the computation of the magnetron turn-on time ratio P based on Equation (2) is performed by only the food surface temperature determined by the thermopile sensor, the sensor may be damaged by various environmental factors.

In order to overcome the above-described problem, the magnetron turn-on time ratio P can be computed by the linear equation to which the temperature variation ratio is added:

$$P=K1*(Tr-T)+K2*\Delta T \quad (3),$$

where ΔT denotes a variation value of the food surface temperature with respect to the unit time. For example, if the magnetron on/off period tm is constant at 10 seconds, ΔT denotes the variation of the food surface temperature experienced during a 10 second interval.

In addition, the following equation may be used for considering the initial temperature of the food based on Equation (3):

$$K1*\{Tr-[K2*T+K3(T-T0)]\}$$

$$K1*[Tr-(T-K3*T0)] \quad (4),$$

where T0 denotes the initial temperature of the food measured by the thermopile sensor, (T−T0) denotes a difference between the current temperature and the initial temperature, K2 and K3 denote weights which are smaller than 1, wherein the values of the same may be set so that Equation of K2+K3=1 is satisfied. In addition, the value of K2 may be eliminated.

Figure 12:
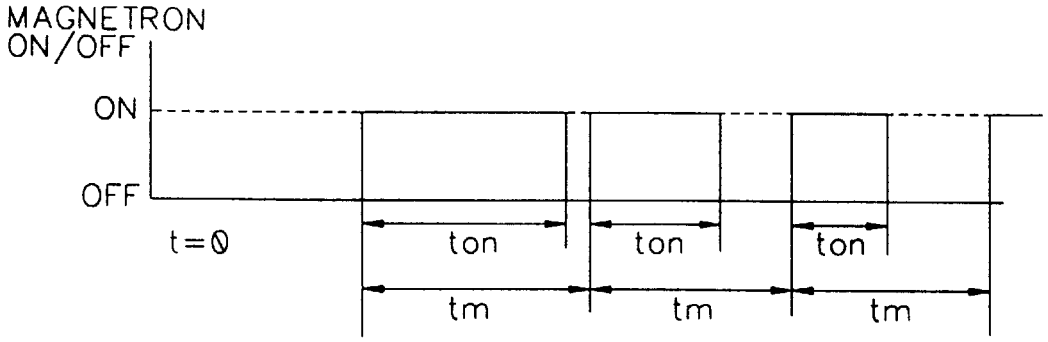
FIG. 12 is a waveform diagram illustrating a magnetron on/off control output in which a magnetron on/off period tm is constant, and a magnetron on/off time varies.

FIG. 12 illustrates examples in which the magnetron on/off period tm is constant, and in which the magnetron turn-on time ton varies.

Figure 13:
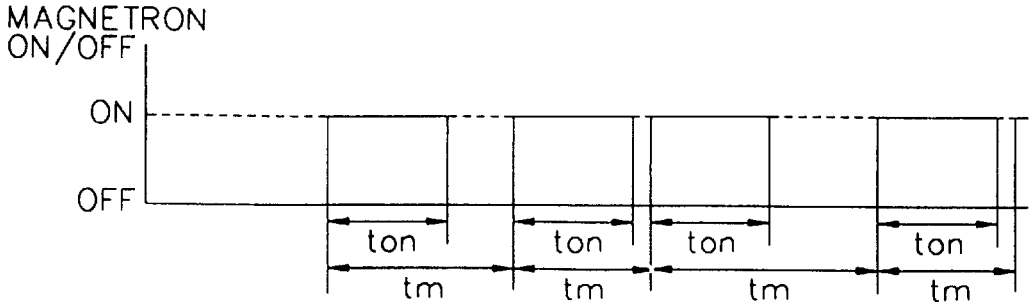
FIG. 13 is a waveform diagram illustrating a magnetron on/off control output in which a magnetron turn-on time is constant, and a magnetron on/off period tm varies.

In Equation 1, the magnetron turn-on time ratio is computed in a state that the magnetron on/off period tm is constant. In addition, the magnetron on/off operation may be controlled by computing the magnetron on/off period tm in accordance with the food surface temperature measured by constantly holding the magnetron on/off time ton as shown in FIG. 13. The magnetron on/off operation may be controlled by computing the magnetron on/off period tm in accordance with the food surface temperature measured by constantly holding the magnetron turn-off time toff.

The magnetron on/off period tm may be computed as follows by using the magnetron turn-on time ratio P computed based on Equations (1) through (4):

$$tm=P*ton \quad (5), \text{ or}$$

$$tm = \frac{toff}{P-1} \quad (6)$$

where the value ton is constantly maintained in Equation (5), and the value toff is constantly maintained in Equation (6).

When thawing the frozen food by using the microwave oven based on the above-described method, it is possible to determine the optimum thawing completion timing as well as the optimum magnetron on/off ratio P based on the amount of food by using the thermopile sensor.

Namely, since it is possible to directly recognize a process that the food surface temperature is being changed, the optimum thawing and heating may be obtained, and it is possible to finish the thawing operation at the optimum time.

Therefore, the frozen food thawing method will now be explained with reference to FIG. 14.

S The sensor module 2 measures the surface temperature Ts of the frozen food 10 and the temperature Te of the portions of the turntable, on which portions the food is not placed, respectively.

Namely, the sensor module 2 measures the temperature T(=W1*Ts+W2*Te) which is obtained by weighting and summing the food surface temperature Ts and the temperature Te.

The weights W1 and W2 used to adjust temperature Ts and Te, respectively, vary in accordance with the size of the food and the internal temperature of the heating chamber 1.

The sensor module 2 converts the measured temperature into a voltage V corresponding to the temperature T and outputs the same to the amplifier 3.

The amplifier 3 amplifies the voltage V to a predetermined level, and the amplified voltage V is processed by the analog/digital converter 4. That is, the thusly amplified voltage is outputted to the analog/digital converter 4.

The analog/digital converter 4 converts the amplified voltage to a digital voltage signal and outputs the converted signal to the microcomputer 5.

The voltage signal sampling unit 51 of the microcomputer 5 samples the digital voltage data from the analog/digital converter 4 at a regular interval and outputs the sampled voltage data to the voltage signal processing unit 52.

The thusly sampled voltage data is converted into temperature by the voltage signal processing unit 52, and the noise contained in the computed temperature T is eliminated. Thereafter, the maximum value, mean value, minimum value, etc. are computed with respect to the computed temperature T, and outputted. The computed temperature T is processed so that the thawing algorithm is performed.

Namely, the voltage signal processing unit 52 performs an algorithm for converting the voltage signal, which is sampled at a constant time ts, into a temperature T. It also performs a digital filter algorithm for eliminating the noise from the temperature T, a maximum value computation algorithm for computing the maximum value Tmax for an off period tm, a minimum value computation algorithm for obtaining a minimum value Tmin for a magnetron on/off period (tem) time, a mean value computation algorithm for computing a mean value Tmean of a temperature for a magnetron on/off period (tm) period, etc. The voltage signal processing unit 52 then outputs the computed temperature data to the temperature data sampling unit 53.

The digital filter algorithm uses the following linear equation by which it is possible to eliminate electromagnetic waves from the sampled voltage data:

$$Tf(t)=\theta 1*Tf(t-ts)+\theta 2*Tf(t-2*ts)+, \ldots, \theta n*Tf(t-n*ts)\ \omega 0*T(t)+ \omega 1*T(t-ts)+, \ldots, +\omega m*T(t-ts) \quad (7),$$

where Tf(t) denotes the temperature value filtered at the time t, Tf(t−ts) denotes the temperature value filtered at the time t−ts, θ1~θn denote the weight to be applied to respective filtered temperature values Tf(t), T(t) denotes a temperature value containing the noise computed by the sampled voltage signal, and ω0~ωm denote the weights to be applied to respective temperature values T(t) containing noises.

For an easier computation by the microcomputer 5, the mean value between the previously measured temperature and the currently measured temperature may be obtained assuming that the weights θ1~θn all have a value of 0, and the weights ω0−ωm all have a value of 1/m.

In addition, the maximum value algorithm, minimum value algorithm, mean value algorithm, etc. are used for computing the maximum value Tmax, minimum value Tmin, mean value Tmean, etc. for the magnetron on/off period tm with respect to the temperature value Tf.

When the thusly computed temperature Tf, and the maximum value, minimum value Tmin, and mean value Tmean with respect to the temperature Tf are outputted to the temperature data sampling unit 53 by the voltage signal processing unit 52, the temperature data sampling unit 53 samples the maximum value Tmax, minimum value Tmin, and mean value Tmean, and outputs the sample values to the magnetron turn-on time ratio computation and abnormal operation judging unit 54.

The magnetron turn-on time ratio computation and abnormal operation judging unit 54 computes the optimum magnetron on/off time by using the temperature Tf and the maximum value Tmax, minimum value Tmin, and mean value Tmean with respect to the temperature Tf based on Equations (1) through (6), determines an additional thawing time ta so that the thawing operation is finished at the optimum time, and judges the abnormal state of the food.

In the magnetron turn-on time ratio computation and abnormal operation judging unit 54, the optimum magnetron turn-on time ratio computation may use the temperature Tf, and the maximum value Tmax, minimum value Tmin, and mean value Tmean with respect to the temperature Tf based on Equations (1) through (6). Since the minimum value Tmin is similar to the mean value of the food surface temperature, the minimum value Tmin is used.

Namely, the magnetron turn-on time ratio is computed by using the minimum value Tmin with respect to the temperature except for the temperature T based on Equations (1) through (6).

In addition, in the magnetron turn-on time ratio computation and abnormal operation judging unit 54, the thawing completion time is determined by using the maximum value Tmax.

FIG. 15 illustrates the maximum value Tmax which is used for determining the thawing completion time.

Namely, as shown in FIG. 15, it is possible to judge the thawing operation completion time at the point, as shown in FIG. 9A, at which the temperature variation ratio is increased (namely, at the point in which the second variation is formed). The most clear variation point appears in the curved line formed with respect to the maximum value, as shown in FIG. 15.

In the magnetron turn-on time ratio computation and abnormal operation judging unit 54, the computation of the additional thawing time is performed by using the time tc at which the second variation point occurs in the graph with respect to the temperature variation, and the temperature Tc of the food at the time tc may be used for the same purpose. A predetermined time may be designated at the time tc, irrespective of the amount of the food.

The additional thawing time ta may be computed based on the following linear equation by using the time tc at which the second variation point is formed and the temperature Tc of the food at that time:

$$ta=C1*tc+C2 \quad (8), \text{ or}$$

$$ta=C3*Tc+C4 \quad (9),$$

where C1, C2, C3 and C4 denote the constants.

Figure 16:
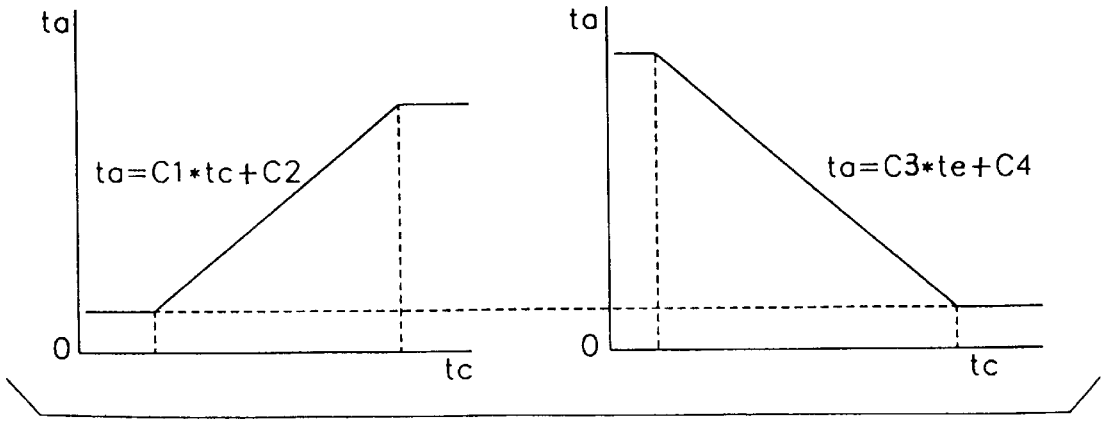
FIG. 16 shows graphs illustrating an additional thawing time computation example according to the present invention.

FIG. 16 illustrates examples with respect to Equations (8) and (9), respectively.

In addition, in the magnetron turn-on time ratio computation and abnormal operation judging unit 54, the state of the food is judged based on the mean value Tmean because the mean value Tmean indicates the entire state of the food more correctly than the maximum value Tmax and minimum value Tmin.

When judging the abnormal state of the food, if the mean value Tmean is larger than a predetermined temperature (for example, 20° C.), the magnetron turn-on time ratio computation and abnormal state judging unit 54 may judge that a user inputted a thawing key in a state that the food is over-thawed or that there is no food. Thus, a signal is immediately outputted for turning off the magnetron 7, thereby terminating the thawing operation.

If the maximum value Tmax is used for judging the abnormal state of the food, the maximum value Tmax may exceed a temperature of 20° C. for the magnetron on/off period time when eccentrically placing the food on the turntable 9.

Therefore, when the frozen food is less thawed, the thawing operation may be terminated.

In addition, if the minimum value Tmin is used for judging the abnormal state of the food, since the amount of the temperature variations decrease toward the end of the thawing operation, a lengthy time is disadvantageously needed so that the minimum value Tmin does not exceed a temperature of 20° C.

The computation of the mean value Tmean may be obtained by using a simple arithmetic mean value. For an easy computation, the value of (Tmax+Tmin)/2 may be used.

In addition, the magnetron turn-on time ratio computation and abnormal state judging unit 54 may judge the abnormal operation of the thawing algorithm by using the magnetron turn-on time ratio and the lapse time until the current time. If determined to be operating abnormally based on this criteria, the magnetron turn-on time ratio computation and abnormal state judging unit 54 outputs a signal to the magnetron on/off switch controller 55 for terminating the thawing operation.

If the magnetron turn-on time ratio is computed as shown in FIG. 11, and the thusly computed value is smaller than 0.2, it is judged that the thawing algorithm failed to search the variation point from the temperature variation curve line. In such a case, the thawing operation will be terminated.

The variation point, at which the temperature variation ratio is increased, appears when the measuring temperature is below 10° C. When the temperature is 10° C., the magnetron turn-on time ratio is 0.5(15−10)=0.25. When the current value is 0.2, the current minimum temperature is 11° C. Therefore, it means that the variation point is already passed.

In addition, when the current magnetron turn-on time ratio is small, and a lengthy time lapsed after the operation of the thawing algorithm, it is judged that the thawing algorithm failed to search the variation point from the temperature variation curve, thereby completing the thawing operation.

As shown in FIG. 11, when the magnetron turn-on time ratio is 0.3, and five minutes lapsed after the operation of the thawing algorithm, the thawing operation is terminated.

As shown in FIG. 14, the magnetron on/off switch controller 5 outputs (1) an on/off control switch to the magnetron on/off switch 6 in accordance with the magnetron turn-on time ratio computed by the magnetron turn-on time ratio computation and abnormal operation judging unit 54 and (2) a result of the thawing operation completion judgement.

The magnetron on/off switch 6 turns on/off the magnetron in accordance with the operation of the on/off control switch.

Figure 17A:
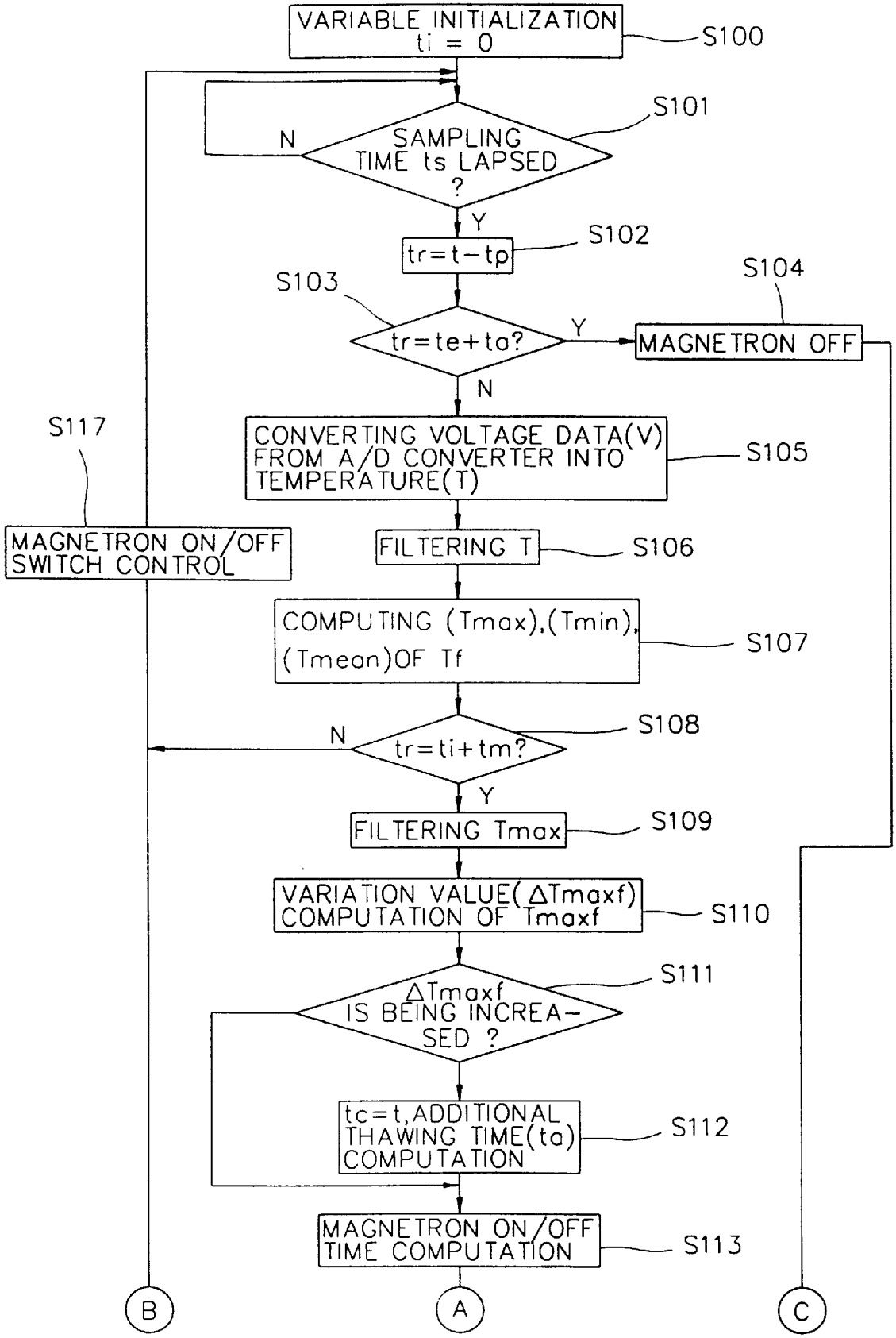
FIGS. 17A and 17B are flow charts illustrating a thawing method for a microwave oven using a thermopile sensor according to the present invention.
Figure 17B:
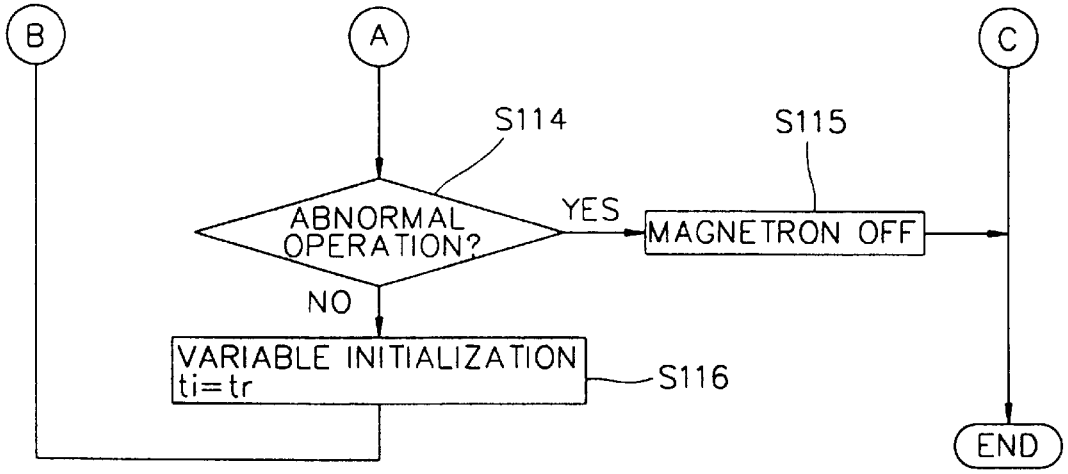
Figure 18:
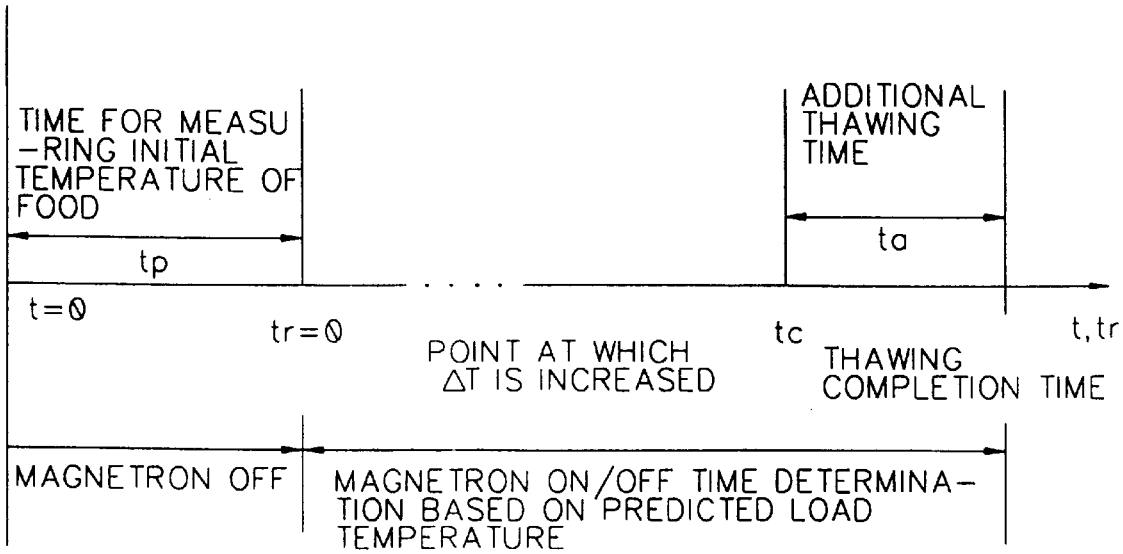
FIG. 18 is a timing diagram when a thawing mode is finished.
Figure 19:
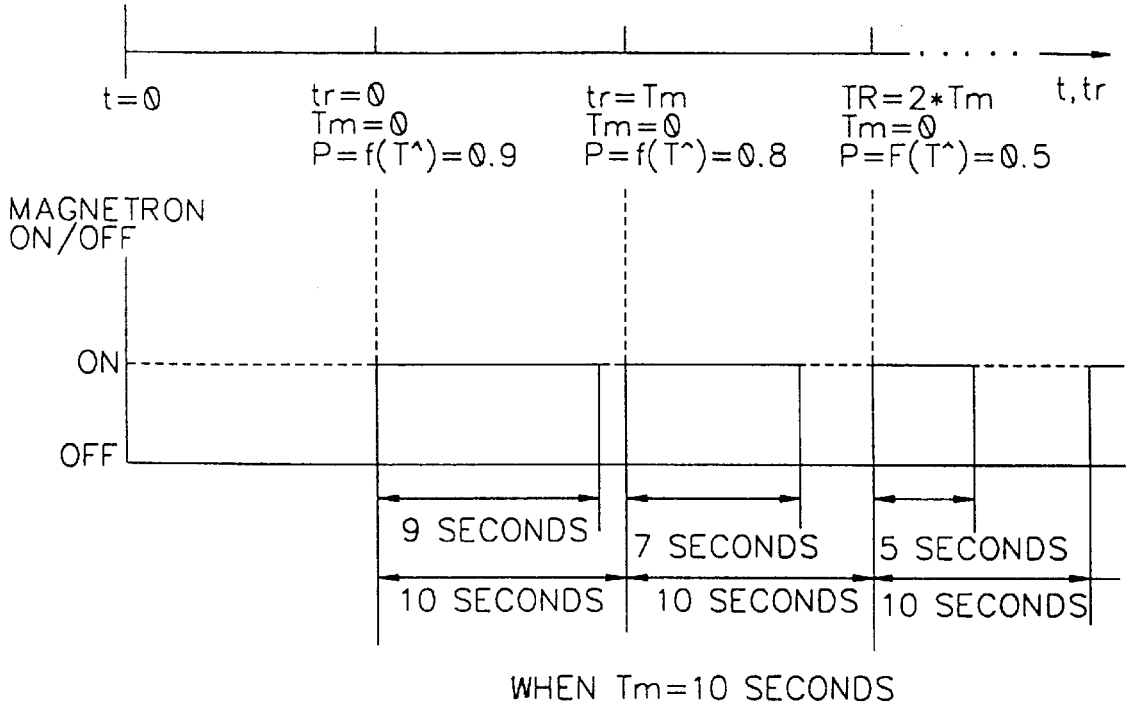
FIG. 19 is a descriptive diagram illustrating an automatic thawing method when a magnetron on/off period is constant, and a magnetron turn-on time is different in the microwave oven of FIG. 14 according to the present invention.

FIGS. 17A and 17B illustrate the thawing method for a microwave oven equipped with the thermopile sensor according to the present invention.

The thawing method therefor, according to the present invention, will now be explained with reference to the accompanying drawings.

First, when a user inputs a thawing key for thawing the frozen food, the variables for performing the algorithm are initialized. Namely, 0 is substituted with the variable ti in step S100.

The magnetron 7 is turned off for an initial time tp after the variables are initialized, and then the initial temperature of the food 10 is measured.

The time tp is the time to which the rotation response time is added until the turntable motor 8 is normally rotated during one rotation time of the turntable 9.

For instance, if one rotation time of the turntable 8 is 10 seconds and the rotation response time of the turntable motor 8 is 3 seconds, the time tp is 13 seconds.

The time t of the thawing operation is continuously counted, and it is checked whether the sampling time ts of the voltage signal lapsed in step S101.

After step S101, the value of tr=t−tp is computed in step S102 after a lapse of sampling time ts. Thereafter, the values of tr and tc+ta are compared in step S103.

As a result of the comparison, if the value of tr is greater than the value of tc+ta, the magnetron 7 is turned off, thereby terminating the thawing operation in step S104. If the value of tr is not greater than tc+ta, the voltage data V from the analog/digital converter 4 is read, for thus computing the temperature T corresponding to the voltage data V in step S105.

Here, the value tc denotes a time at which the food surface temperature variation ratio is increased, and the value of ta denotes an additional thawing time from the time tc.

The temperature T computed in step S105 is filtered by using the digital filter algorithm, thereby computing the temperature Tf, from which noise is eliminated, in step S106.

When the computation of the temperature Tf is finished in step S106, the maximum value Tmax, minimum value Tmin, and mean value Tmean are computed for the magnetron on/off period (tm) time in step S107, and the values of tr and ti+tm are compared in step S108 to determine whether the magnetron on/off period tm lapsed in step S208.

As a result of the judgement, if the magnetron on/off period (tm) time did not lapse, namely, if the values ti and tm are different, a control signal is outputted to the magnetron on/off switch, and steps S101 through S107 are repeatedly performed. If the magnetron on/off period tm lapsed, namely, if the values tr and ti+tm are identical, the maximum value Tmax with respect to the temperature Tf of the food is filtered, thus obtaining the filtered value Tmaxf in step S109.

At this time, the mean value of the values of Tmax (t−tm) and Tmax(t) is obtained as follows:

$$T\max(t) = \frac{T\max(t - tm) + T\max(t)}{2}, \tag{10}$$

where Tmax(t) denotes the maximum value Tmax computed at the time t.

The variation of the maximum value Tmaxf is computed as follows in step S110.

$$\Delta Tmaxf(t) = Tmaxf(t) - Tmaxf(t - tm) \tag{11},$$

where ΔTmaxf(t) denotes the value of ΔTmax computed at the time t.

When the varied value ATmax of the maximum value is computed, it is judged whether the varied value is increased in step S111.

Figure 20A:
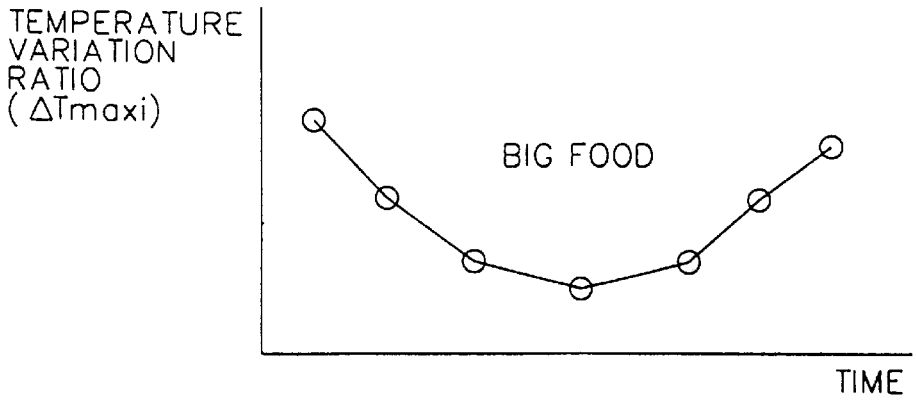
FIGS. 20A through 20D are graphs illustrating temperature variation ratios of a variation value ΔTmaxf with respect to the value Tmaxf which is obtained by filtering the maximum value Tmax with respect to the temperature according to the present invention.
Figure 20B:
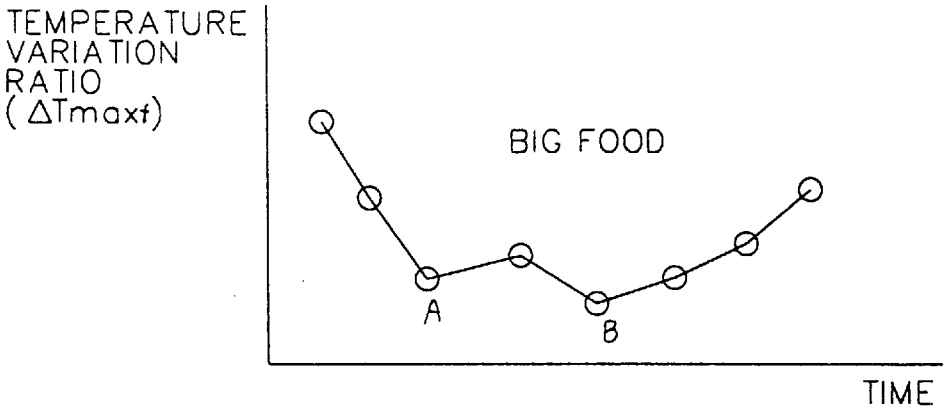

As shown in FIGS. 20A through 20D, the increasing timing of the varied value ΔTmax of the maximum value filtered under conditions such as the amount of food, etc. appear differently. In particular, as shown in FIG. 20B, it is impossible to judge the variation point by the increase of the value ΔTmax.

Namely, as shown in FIG. 20B, even though the point B is an actual variation point, the point A may be erroneously recognized as an actual variation point, for thus less thawing the frozen food.

Figure 20C:
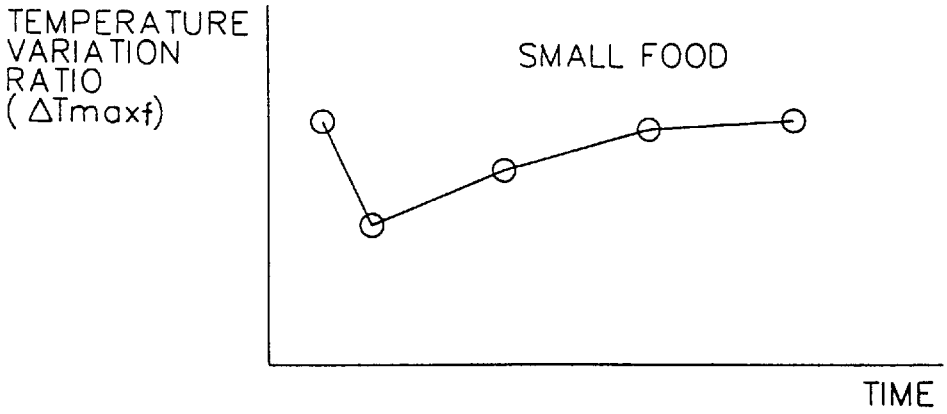
Figure 20D:
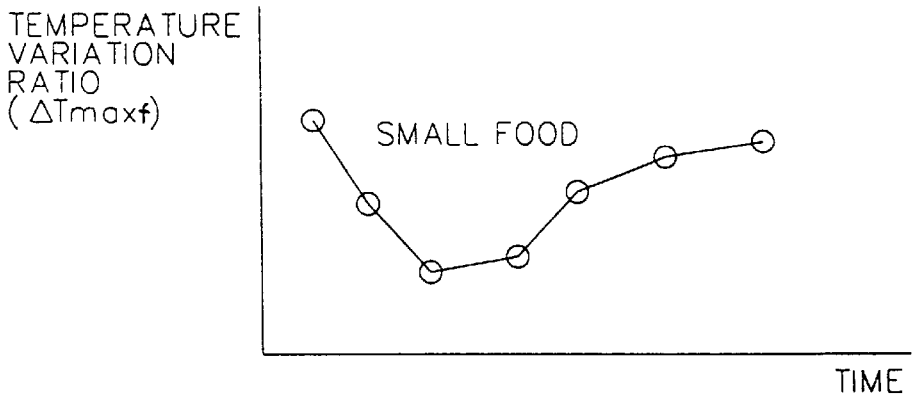

In addition, if the food is small, as shown in FIGS. 20C and 20D, since the variation point appears within short time, the number of data available for judging the variation point is restricted.

Figure 21:
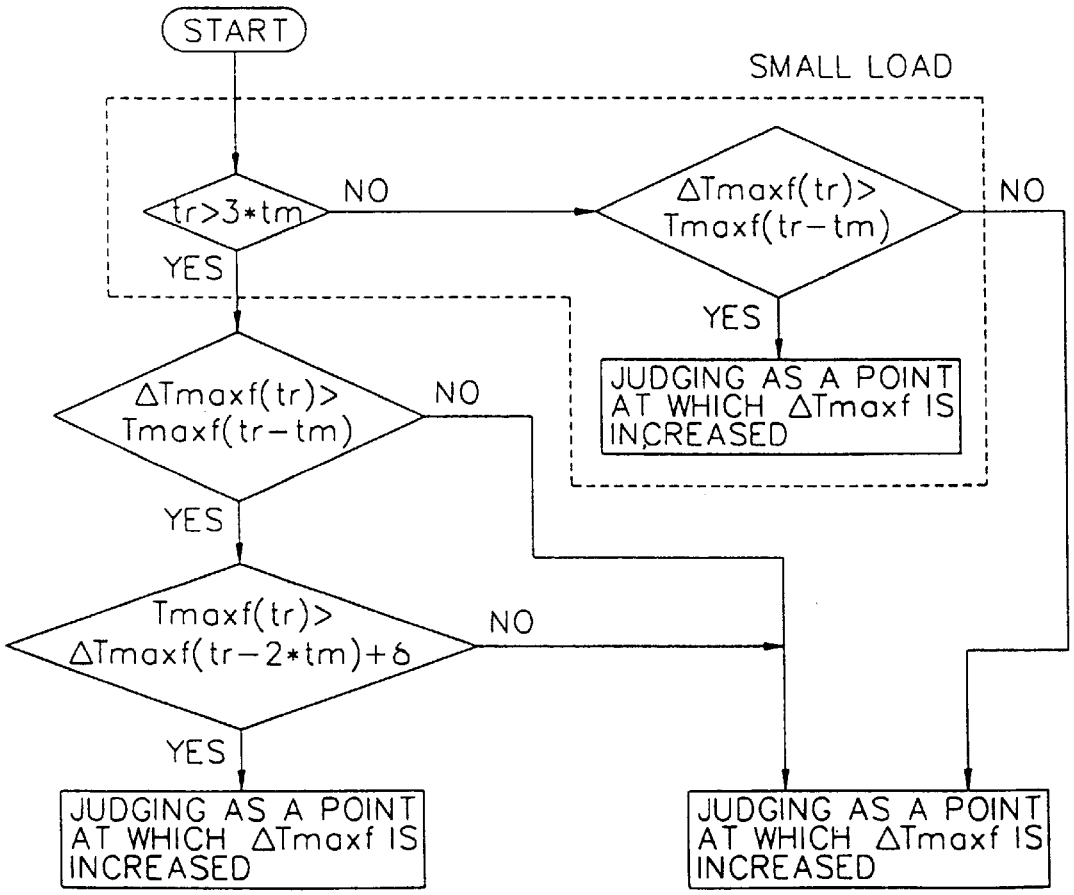
FIG. 21 is a flow chart illustrating a method for judging an increase of the value ATmaxf in the microwave oven of FIG. 17.

FIG. 21 illustrates a variation point judging method for avoiding the above-described problems.

Namely, when the value tr is smaller than the magnetron on/off 3-period (3*tm), the value of ΔTmaxf(tr) representing the current value of ΔTmaxf is compared to the value of ΔTmaxf(tr−tm) representing the value of ΔTmaxf at a time tm before the time tr. As a result of the comparison, if the value of ΔTmaxf(tr) is greater than the value of ΔTmaxf(tr−tm), the value of ΔTmaxf is determined to be being increased. If the value of Tmaxf(tr) is smaller than the same, the value of ΔTmaxf is determined not to be being increased.

In addition, if the value of tr is greater than the value tm, the value of ΔTmaxf(t) representing the current value ΔTmaxf is compared to the values of ΔTmaxf(tr−tm) and ΔTmaxf(tr−2*tm) representing the values of ΔTmaxf at a time tm before the time tr and time 2*tm. As a result of the comparison, if the value of ΔTmaxf(tr) is greater than the value of ΔTmaxf(tr−tm), or if the value of ΔTmaxf(tr) is greater than the value of ΔTmaxf(tr−2*tm)+δ, where δ denotes a positive number greater than 0, the value of ΔTmaxf is determined to be being increased.

In Step S111, if ΔTmaxf is determined to be being increased, the additional thawing time is computed based on Equations (8) and (9), and the current time t is substituted with the variable tc in step S112.

Next, the magnetron turn-on time ratio P is computed based on Equations (1) through (7) in step S113. Thereafter, it is determined whether there is an abnormal state in the thawing algorithm or in the food in step S114.

Here, when determining the abnormal state, the mean value Tmean, the magnetron turn-on time ratio p, the current lapse time, etc. are used.

In step S114, if it is determined that there is an abnormal state therein, the magnetron 7 is turned off, thus terminating the thawing operation. If it is determined that there is not an abnormal state, a control signal is outputted to the magnetron on/off switch 6.

Next, variables are initialized for computing the above-described values with respect to a new magnetron on/off period time (tm), and the value ti is substituted with the value tr.

Therefore, the frozen food is thawed by the optimum thawing time through the above-described steps.

So far, the magnetron controlled through the turn-on or turn-off operations was described. If a user wants to control the magnetron through multiple operations, the magnetron on/off time computation method may be changed with a computation method for computing the amount of the magnetron outputs.

Namely, the magnetron turn-on time ratio P computed through Equations (1) through (5) is changed with the amount of the magnetron outputs.

Therefore, it is possible to thaw the frozen food in optimum state, irrespective of the size of a food by controlling the output from the magnetron by using the measuring data from the thermopile sensor, for thus shortening the maximum thawing time.

In addition, another method for determining the thawing completion time will now be explained. The thawing completion time is determined by the magnetron turn-on time ratio P and the temperature increase ratio.

$$P - Kd^*\{T(k) - T(k-1)\} \leqq Dr \tag{12}.$$

If the above-described Equation (12) is satisfied, the thawing operation is finished.

In Equation (12), T(k−1) denotes the temperature of the food measured before the magnetron on/off period (tim) time, Dr denotes the constant, and Kd denotes the value which varies in accordance with the eccentric amount of the load (food).

Figure 22:
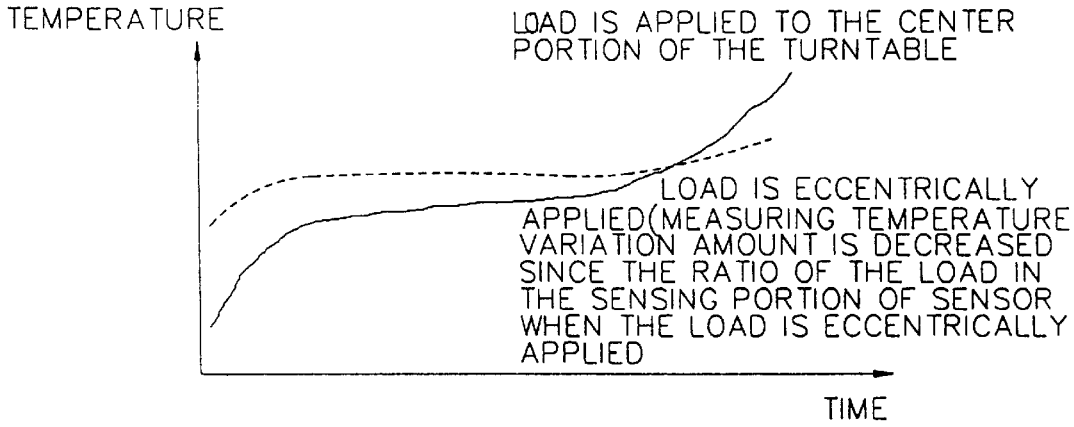
FIG. 22 is a graph illustrating an interrelationship between an eccentric amount and a measured temperature variation with respect to the identical electric load according to the present invention.

FIG. 22 illustrates the temperature variation measured by the thermopile sensor in accordance with the eccentric amount of the load (food).

Finally, in the case of the eccentric load, since the amount of the temperature variation is small, the thawing completion time is extended, thus causing overthawing.

Therefore, in the case of the eccentric load, the value Kd is increased, so that the thawing operation with respect to the small amount of the temperature variation is terminated.

In order to measure the eccentric amount of the load, the variation amount AO of the measuring temperature which is obtained during one rotation of the turntable is used.

Figure 23:
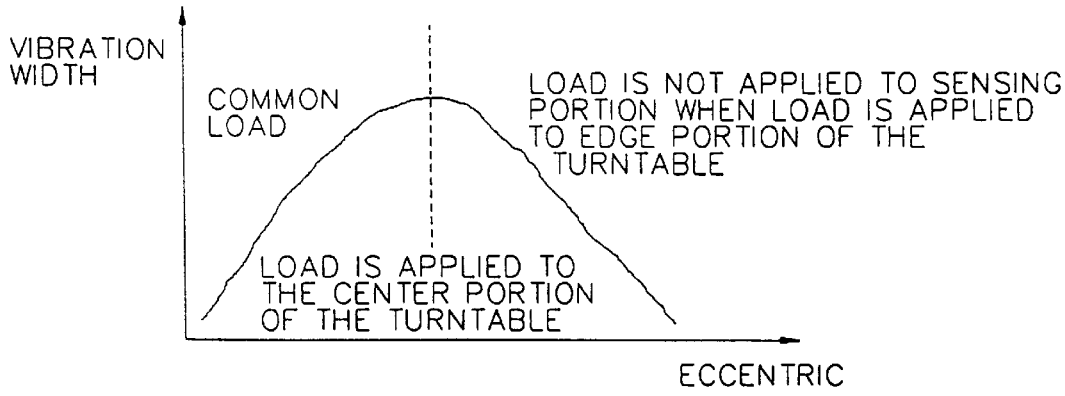
FIG. 23 is a graph illustrating an interrelationship between an eccentric amount of an electric load and a variation amount which is obtained when a turntable is rotated according to the present invention.
Figure 24:
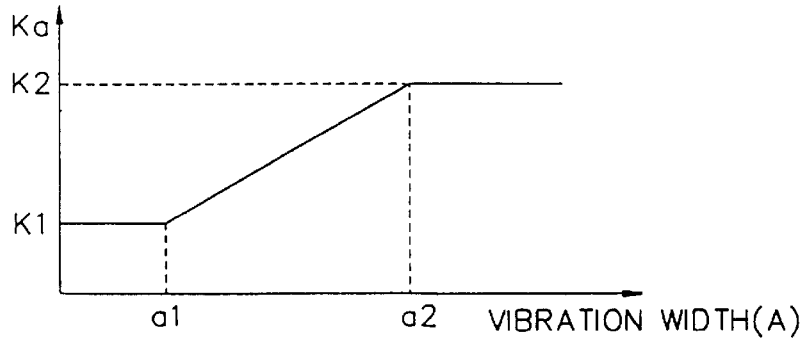
FIG. 24 is a graph illustrating an interrelationship between a variation amount and a value of Kd according to the present invention.

FIG. 23 illustrates the variation of the variation amount AO of the measuring temperature based on the eccentric amount of the load when the turntable is rotated. As shown therein, the variation amount AO of the measuring temperature that is obtained during one rotation is increased as the eccentric amount of the load is increased.

In order to compute the value of Kd in accordance with the eccentric amount of the load, an interrelationship between the variation amount AO and the value of Kd, which vary in accordance with the eccentric amount, must be obtained. In the present invention, the value of Kd is computed from the variation amount by using the look-up table LOOK-UP TABLE.

For example, the value of Kd is set as K1 in a value range in which the variation amount is smaller than a constant of a1, and the value of Kd is set as K2 in a value range in which the variation amount is greater than a constant a2.

If the variation amount is between the values of a1 and a2, the value of Kd is set between the values of K1 and K2.

The method of determining the thawing completion timing based on the eccentric amount of the load and the variation amount will now be explained with reference to FIG. 25. The initial values of the variables for performing the thawing operation when a thawing key is inputted are designated in step S200.

The variation amount aO of the measuring temperature for one rotation time of the turntable is computed in step S201.

The value of Kd is computed by using the look-up table in accordance with the variation amount aO computed in step S201 and in step S202. The current temperature T(k) of the food is measured whenever the magnetron on/off period (tm) lapses after the value of Kd is computed. Thereafter, the magnetron turn-on time ratio P is computed, in step S203, by multiplying the temperature value, which is obtained by subtracting the initial temperature T(O) from the current temperature T(k), by the value of Kd. The thawing operation is terminated when the value which is obtained by subtracting the value, which is obtained by multiplying the varied amount of T(k)−T(k−1) of the load temperature measured at every magnetron on/off period(tm) by the value of Kd, from the magnetron turn-on time ratio P obtained in step S203 is smaller than or identical to the constant Dr. In the other cases, the operation is repeatedly performed by increasing one magnetron on/off period.

The variation amount AO of the temperature measured during one rotation of the turntable and the thawing completion timing are determined in accordance with the eccentric amount of the load, for thus thawing the frozen food.

As described above, the microwave oven thawing method using a thermopile type sensor according to the present invention is capable of thawing a frozen food at optimum condition irrespective of the size of the food by controlling the output from the magnetron by using the measuring temperature of one thermopile sensor, thus shortening the thawing time and computing the variation amount of the measuring temperature for one rotation time of the turntable by using the thermopile sensor. In addition, it is possible to enable an optimum thawing operation irrespective of the position of the load (food) by determining the thawing completion time based on the eccentric amount of the load.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. In a microwave oven equipped with a thermopile including light condensing means for condensing an infrared ray from at least one of food and a turntable within the microwave oven, a thermopile sensor module for generating a voltage based on output from the light condensing means, and an amplifier for amplifying the voltage generated by the thermopile sensor module to a predetermined level, and an analog/digital converter for converting the voltage signal from the amplifier into a digital voltage signal, and a microcomputer for processing a voltage signal from the analog/digital converter and for controlling an energy supplied from the magnetron to the food placed in a heating chamber based on an internally provided thawing program, said microcomputer comprising:

a voltage signal sampling unit for periodically reading a digital signal from the analog/digital converter;

a voltage signal processing unit for converting the digital signal periodically read by the voltage signal sampling unit into a temperature, eliminating a noise from the converted temperature, and computing a maximum value, a minimum value, and a mean value of the temperature corresponding to a magnetron on/off period;

a temperature data sampling unit for sampling the maximum value, the minimum value, and the mean value computed by the voltage signal processing unit;

a magnetron turn-on ratio computation and abnormal operation judging unit for computing an optimum magnetron on/off time for a magnetron on/off period based on the data sampled by the temperature data sampling unit, determining the thawing completion time so that the thawing operation is terminated at an optimum time, and terminating the thawing operation when an abnormal operation is detected based on a state of the food; and a magnetron on/off switch controller for outputting a control signal to the magnetron on/off switch in accordance with an output from the magnetron turn-on time ratio computation and abnormal operation judging unit.

2. The microwave oven of claim 1, wherein said voltage signal processing unit processes signals using an algorithm for converting the voltage signal periodically read by the voltage sampling unit, a digital filter algorithm for eliminating a noise from the temperature, a maximum value computation algorithm for computing the maximum value of a temperature corresponding to a magnetron on/off period, a minimum value computation algorithm for computing a minimum value of a temperature corresponding to a magnetron on/off period, and a mean value computation algorithm for computing a mean value of a temperature corresponding to a magnetron on/off period.

3. A thawing method for a microwave oven including a magnetron and a thermopile sensor, the microwave oven accommodating food on a turntable, the thawing method comprising:

a first step for turning on the magnetron after a delay time corresponding to a combination of a time for one rotation of the turntable and a rotation response time defined by an amount of time that a turntable motor is normally rotated, and detecting an initial temperature of the food;

a second step for filtering the temperature detected in the first step by using a digital filer and computing a maximum value, a minimum value, and a mean value corresponding to a magnetron on/off period with respect to the filtered temperature;

a third step for judging whether the magnetron on/off period lapsed, for returning to the first and second steps when the magnetron on/off period is not determined to have lapsed, and for computing a filtering value by filtering the maximum value when the magnetron on/off period is determined to have lapsed;

a fourth step for computing a varied value of the filtering value of the maximum value in the third step and determining an increase in the value;

a fifth step for computing an additional thawing time when the varied value is increased in the fourth step, for determining a thawing completion time, for computing a magnetron turn-on time ratio, and for computing the magnetron turn-on time ratio when the varied value is not increased;

a sixth step for judging an operation state of a thawing algorithm and an abnormal state of a food based on the magnetron turn-on time ratio, and the mean value, and a current lapse time; and a seventh step for terminating a thawing operation by turning off the magnetron when the operation is judged to be in an abnormal state in the sixth step, and for returning to the first step when the operation is judged not to be in an abnormal state.

4. The method of claim 3, wherein said magnetron turn-on time ratio is computed based on a minimum value with respect to the temperature of a food.

5. The method of claim 3, wherein said thawing completion time is computed based on a maximum value with respect to the temperature of a food.

6. The method of claim 3, wherein said abnormal state is judged based on the mean time, the magnetron turn-on time ratio, and the current lapse time with respect to the temperature.

7. The method of claim 3, wherein the varied value of the filtering value of the maximum value in the fourth step is judged to be increasing when a current varied value is greater than a varied value at a predetermined amount of time earlier, and wherein the varied value of the filtering value of the maximum value in the fourth step is judged not to be increasing when the current varied value is not greater than the varied value at the predetermined amount of time earlier, each judgment being made by comparing the current varied value with the varied value at the predetermined amount of time earlier which corresponds to a time when the current lapse time is smaller than the magnetron on/off 3-period.

8. The method of claim 3, wherein the varied value of the filtering value of the maximum value in the fourth step is judged to be increasing when the current varied value is greater than a varied value at a predetermined amount of time earlier, and the current varied value is greater than a varied value at a second predetermined amount of time that is twice the first predetermined amount of time earlier by comparing the current varied value with the varied values at the first and second predetermined times earlier which correspond to a time when the current lapse time is greater than the magnetron on/off 3-period.

9. A thawing method for a microwave over including a magnetron and a thermopile sensor, the microwave oven accommodating food on a turntable, the thawing method comprising:

beginning a thawing operation in response to a user input;

determining a temperature variation for one rotation time of a turntable based on output from the thermopile sensor;

computing a value which varies in accordance with the temperature variation computed;

computing a magnetron turn-on time ratio by using different weights to multiply a temperature value which is obtained by subtracting an initial temperature from the current temperature of the food at each magnetron on/off period; and terminating the thawing operation based on a level of the value which is obtained by multiplying the computed value by a food temperature variation amount measured at every magnetron on/off period.

10. A processor for a microwave oven including a temperature sensing device and a magnetron, the processor comprising:

determining means for determining a maximum value, a minimum value, and a mean value of a temperature corresponding to a period of the magnetron based on input from a temperature sensing device;

computing means for computing an optimum duty cycle for a magnetron driving signal based on the maximum value, the minimum value, and the mean value of a temperature determined corresponding to a single period of the magnetron; and generating means for generating the magnetron driving signal having a duty cycle based on the optimum duty cycle computed by the computing means.

11. The processor recited by claim 10, wherein the magnetron driving signal generated by the generating means has a constant period, a pulse width within the period of the magnetron driving signal being defined by the optimum duty cycle computed by the computing means.

12. The processor recited by claim 10, wherein the magnetron driving signal generated by the generating means has a period that is defined by the optimum duty cycle computed by the computing means, a pulse width within the period of the magnetron driving signal being constant.

13. A method for generating a driving signal for driving a magnetron in a microwave oven, the method comprising:

determining a maximum value, a minimum value, and a mean value of a temperature corresponding to a period of the magnetron based on input from a temperature sensing device;

computing an optimum duty cycle for a magnetron driving signal based on the maximum value, the minimum value, and the mean value of a temperature determined corresponding to a single period of the magnetron; and generating the magnetron driving signal having a duty cycle based on the optimum duty cycle.

14. The method recited by claim 13, wherein the magnetron driving signal is generated with a constant period, a pulse width within the period of the magnetron driving signal being defined by the optimum duty cycle.

15. The method recited by claim 13, wherein the magnetron driving signal is generated with a period that is defined by the optimum duty cycle, a pulse width within the period of the magnetron driving signal being constant.

* * * * *